US010720005B2

(12) United States Patent
Lovell, Sr.

(10) Patent No.: US 10,720,005 B2
(45) Date of Patent: Jul. 21, 2020

(54) GAME OF CHANCE ALLOWING USER PARTICIPATION IN OUTCOME SELECTION

(71) Applicant: John G. Lovell, Sr., Knoxville, TN (US)

(72) Inventor: John G. Lovell, Sr., Knoxville, TN (US)

( * ) Notice: Subject to any disclaimer, the term of this patent is extended or adjusted under 35 U.S.C. 154(b) by 0 days.

(21) Appl. No.: 15/584,560

(22) Filed: May 2, 2017

(65) Prior Publication Data

US 2017/0236359 A1 Aug. 17, 2017

Related U.S. Application Data

(63) Continuation-in-part of application No. 13/622,092, filed on Sep. 18, 2012, now abandoned.

(51) Int. Cl.
*G07F 17/32* (2006.01)

(52) U.S. Cl.
CPC ..... *G07F 17/32* (2013.01); *G07F 17/3262* (2013.01)

(58) Field of Classification Search
CPC ..... A63F 3/0665; G07F 17/3262; G07F 17/32
See application file for complete search history.

(56) References Cited

U.S. PATENT DOCUMENTS

| | | | | |
|---|---|---|---|---|
| 5,092,598 | A | 3/1992 | Kamille | |
| 6,203,427 | B1 * | 3/2001 | Walker | G06Q 50/34 463/16 |
| 6,572,471 | B1 * | 6/2003 | Bennett | G07F 17/34 273/139 |
| 6,616,531 | B1 | 9/2003 | Mullins | |
| 8,463,765 | B2 | 6/2013 | Lesavich | |
| 9,037,564 | B2 | 5/2015 | Lesavich et al. | |
| 9,137,250 | B2 | 9/2015 | Lesavich et al. | |
| 9,361,479 | B2 | 6/2016 | Lesavich et al. | |
| 9,569,771 | B2 | 2/2017 | Lesavich et al. | |
| 2012/0278622 | A1 | 11/2012 | Lesavich et al. | |
| 2014/0080566 | A1 | 3/2014 | Lovell, Sr. | |
| 2014/0189752 | A1 | 7/2014 | Lesavich et al. | |
| 2015/0011287 | A1 | 1/2015 | Lovell, Sr. | |
| 2015/0379301 | A1 | 12/2015 | Lesavich et al. | |
| 2016/0321654 | A1 | 11/2016 | Lesavich et al. | |

FOREIGN PATENT DOCUMENTS

| | | |
|---|---|---|
| CA | 2827433 | 9/2013 |

* cited by examiner

*Primary Examiner* — David L Lewis
*Assistant Examiner* — Robert E Mosser
(74) *Attorney, Agent, or Firm* — Lesavich High-Tech Law Group, S.C.

(57) ABSTRACT

A game of chance is disclosed allowing an outcome determined by the actions of a player. The game of chance comprises a layout defining a plurality of cells. A first portion of the cells each have a winning indicia contained therein, and a remaining portion of the cells each have a non-winning indicia contained therein. The winning and non-winning indicia are initially concealed to a player and are selectively revealable by the player. The player may select a limited number of cells to reveal the indicia contained therein. An object of the game is to maximize a number of winning indicia revealed by the player.

19 Claims, 12 Drawing Sheets

GAME OF CHANCE ALLOWING USER PARTICIPATION IN OUTCOME SELECTION

CROSS REFERENCES TO RELATED APPLICATIONS

This U.S. utility patent application is a Continuation-In-Part (CIP) of U.S. utility patent application Ser. No. 13/622,092, filed on Sep. 18, 2012, the contents of which are incorporated by reference.

FIELD OF INVENTION

This application relates to automatic processing of electronic information. More specifically, it relates to a method and system for automated intelligent advertising.

BACKGROUND OF THE INVENTION

Games of chance involving one or more wagers on the outcome of a statistical event are generally known in the art. For example, in various lottery-type games of chance, a player typically pays an initial fee to participate in the game, whereupon lots are assigned among the various players of the game. Lots are then drawn to determine one or more winners, and each winner of the lottery game is typically rewarded with a prize, often a monetary amount equivalent to a portion of the proceeds from the initial fees. Assignment of lots in a lottery game is typically accomplished by assigning each player a number or other such designation, often printed on a card known as a "lottery ticket."

Depending upon the specific lottery game being played, the lottery ticket and/or process of drawing lots to determine winners can take any of a number of forms. For example, in several lottery games, small cards known as "scratchcards" are used as lottery tickets. A scratchcard is a small card, often made of paper or plastic material, where one or more areas of the card contain concealed information which can be revealed by scratching off an opaque covering. In certain lottery games, an assigned lottery number is initially printed as concealed information on a scratchcard lottery ticket issued to the player, and the player reveals the concealed information in order to learn the assigned lottery number before lots are drawn to determine the lottery winner. In other lottery games, known as "instant win" games, the concealed information printed on a scratchcard lottery ticket, once revealed, immediately indicates whether the ticket is a winner. In each of these types of games, a significant drawback exists in that, once a player is assigned a scratchcard lottery ticket, the player has essentially no further input regarding the outcome of the lottery game, and must instead merely accept whatever information printed on the scratch-card assigned to the player. Thus, a player often feels as though they are not in control of the lottery game, and that the outcome of the game is instead determined solely by the actions of others, such as for example the distributor of the scratchcards.

In yet another lottery game, a scratchcard containing several areas of concealed information is issued to the player, and the player selects only a portion of the areas of concealed information on a given scratchcard to reveal. In this type of game, whether the player wins or not depends upon both the information printed on the card and the specific portions which are selected to be revealed. In the event a player reveals a losing combination of information, a player can then scratch off all areas of the scratchcard to see if, how, and what the player could have won with the particular card. This type of lottery game and the "instant win" lottery game described above are often popular due to the opportunity for a player to be determined as a winner immediately upon revealing the concealed information on the scratchcard, as opposed to waiting for a traditional drawing of lots. However, a significant drawback to these types of games lies in the fact that a player often does not know whether the particular scratchcard issued to the player is capable of winning before the player begins revealing the concealed information on the scratchcard. Thus, the player again feels as though the outcome of the game is determined, at least in part, by the assignor of the scratchcards, rather than by the actions of the player. Furthermore, this type of scratchcard game is vulnerable to tampering. For example, in the event a player is able to successfully scratch off the appropriate areas of a winning scratchcard such that the player wins the game, the winning scratchcard may nonetheless be voided through intentional or accidental scratching of additional areas.

In another game of chance, called "bingo," each player is provided with a card that includes a matrix of five rows and five columns defining twenty-five grid squares. The left-most column is labeled "B", the second column "I", the third column "N", the fourth column "G" and the right-most column "0". Traditionally, each grid square, with the exception of the "free" center grid square, is labeled with a number in the range of 1 to 75. The grid squares in the "B" column use the numbers in the range of 1 to 15. The squares in the "I" column use the numbers in the range of 16 to 30. The grid squares in the "N" column, except the center square, use the numbers in the range of 31 to 45. The grid squares in the "G" column use the numbers in the range of 46 to 60. The grid squares in the "0" column use the numbers in the range of 61 to 75. Each grid square is defined by the combination of a letter identifying the column and a number. As a caller randomly calls combinations of columns and numbers, each player indicates which of that player's grid squares had been called, either through markings in the grid squares or by placing items on the squares. The first person to achieve a pre-determined pattern of called grid squares is the winner of that game. Examples of patterns include: one straight line, two straight lines; the entire card, the border of the grid, etc.

In the above-described game of bingo, each game card has the opportunity to be a winner, depending on the particular combinations of columns and numbers called by the caller. However, the player is typically not in control of the particular combinations of columns and numbers selected by the caller. Thus, as with the lottery games described above, the player often feels subjected to the actions of another, such as for example the caller of the combinations of columns and numbers, and therefore feels out of control of the outcome of the bingo game.

In games of chance in which a player feels that they are not in control of the outcome of the game, a player may often suspect that the outcome of the game has been unfairly manipulated, or that the game has been subjected to some other form of fraud, particularly if the player experiences multiple losses through repeatedly playing the same game. However, such suspicions of fraud in games of chance are much less likely if the player is made to feel in control of the game's outcome. Accordingly, there is a need for an improved game of chance, wherein the game involves player participation in selection of the game's outcome.

Thus, there is a need for an improved game of chance which is less vulnerable to tampering than the above-discussed scratchcard games implemented electronically on a network device.

SUMMARY OF THE INVENTION

A game of chance having an outcome determined by the actions of a player The game of chance comprising a layout defining plural cells. A first portion of the cells each have a winning indicia contained therein, and a remaining portion of the cells each have a non-winning indicia contained therein. The winning and non-winning indicia are initially concealed to a player and are selectively revealable by the player. The player may select a limited number of cells to reveal indicia contained therein. An object of the game is to maximize a number of winning indicia revealed by the player.

BRIEF DESCRIPTION OF HE DRAWINGS

Preferred embodiments of the present invention are described with reference to the following drawings, wherein.

Figure 6:
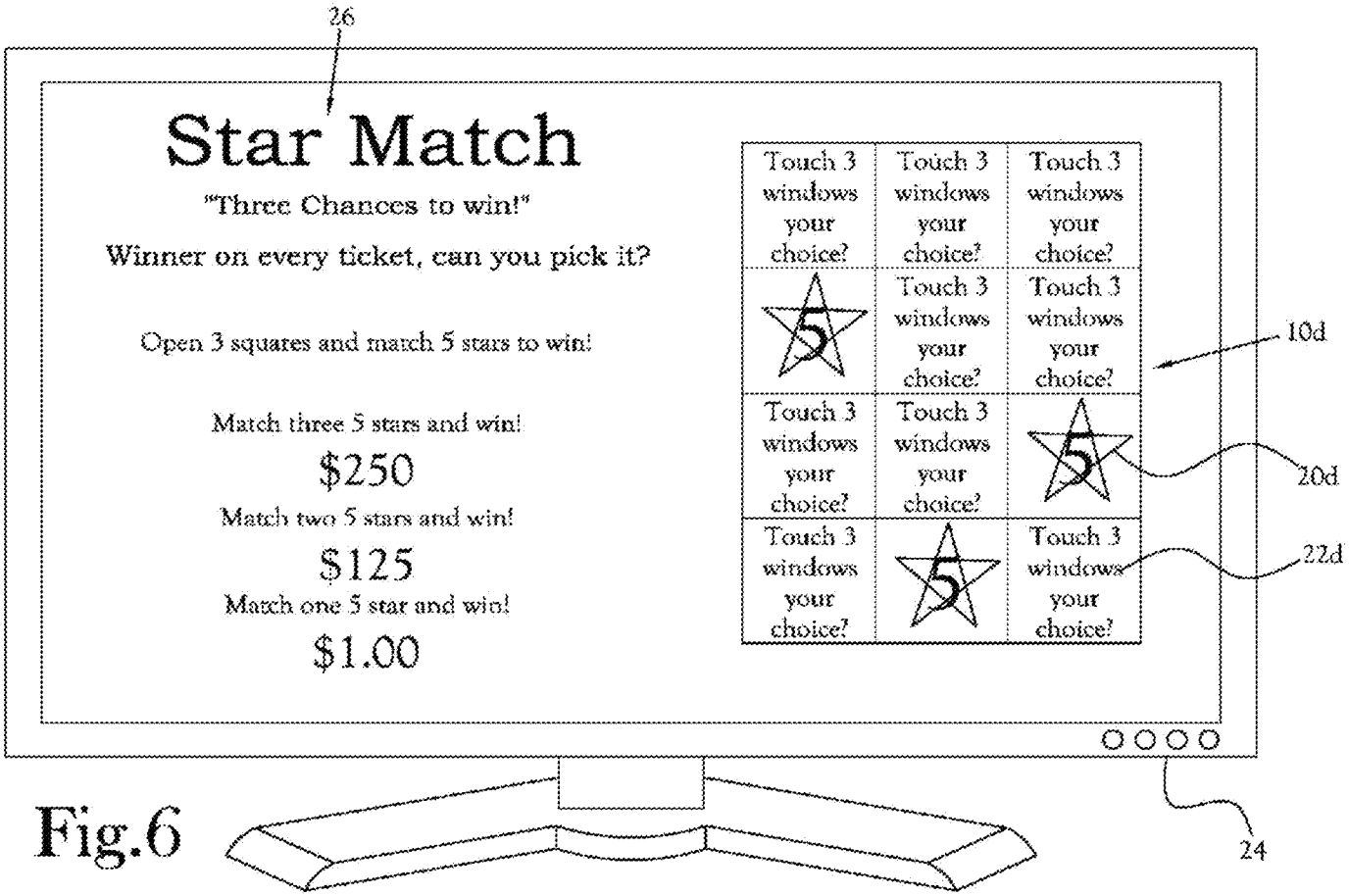
Figure 7:
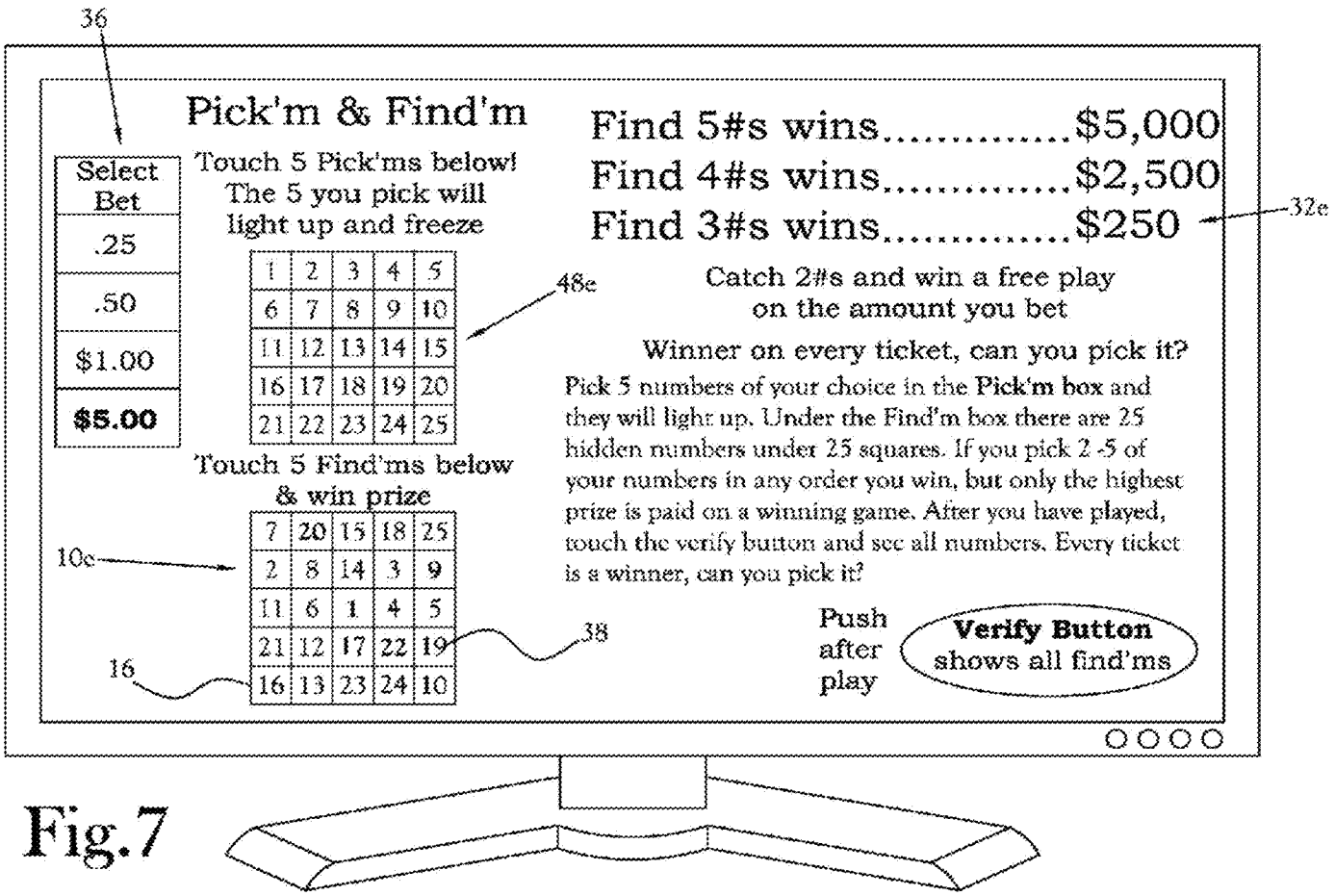

FIG. 6 is a depiction of a graphical user interface showing another embodiment of a game of chance constructed in accordance with several features of the present general inventive concept; and FIG. 7 is a depiction of a graphical user interface showing another embodiment of a game of chance constructed in accordance with several features of the present general inventive concept; and FIGS. 8A, 8B, 8C and 8D are a flow diagram illustrating a method for playing a game of chance.

DETAILED DESCRIPTION OF THE INVENTION

Figure 1A:
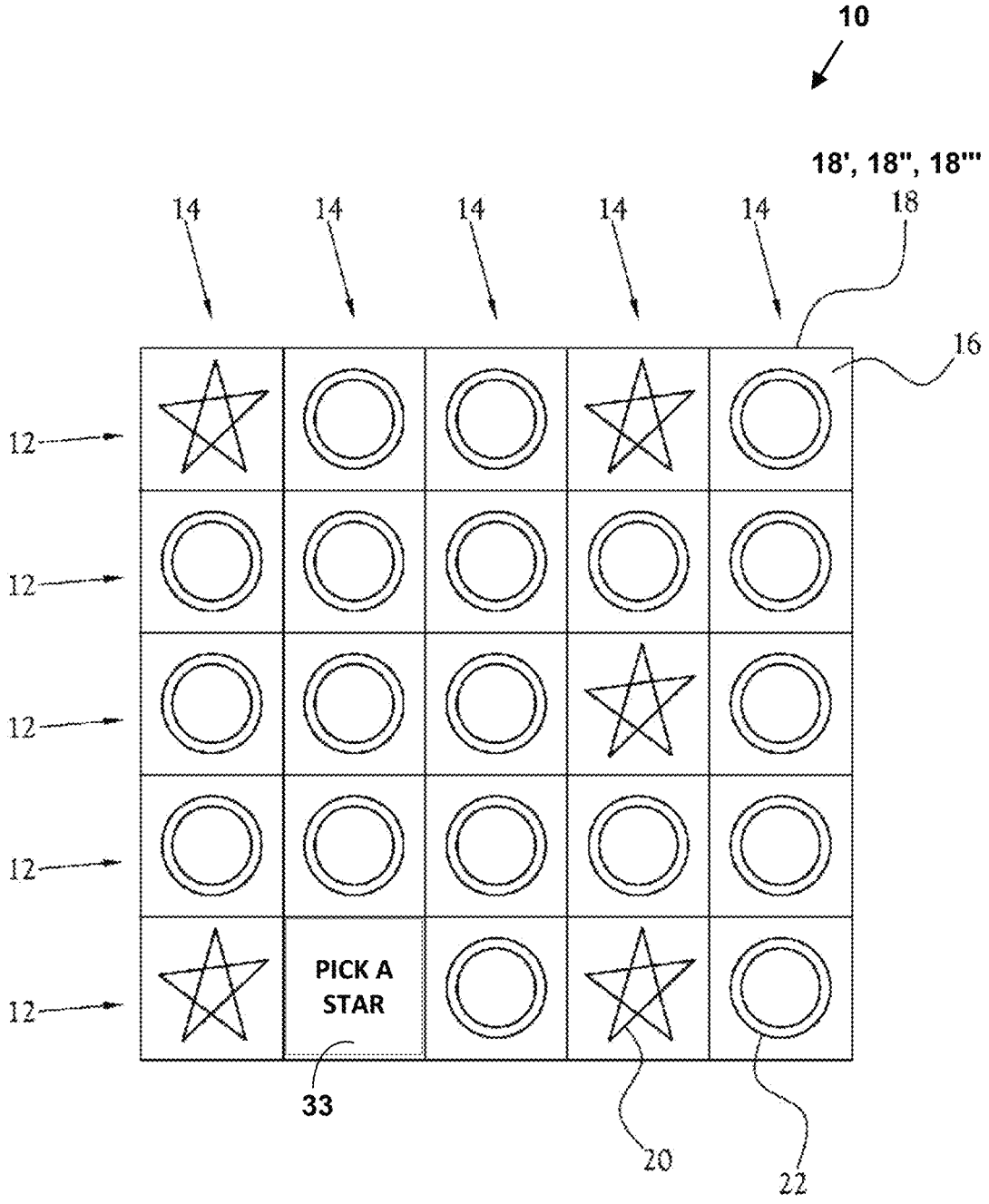
FIG. 1A is a depiction of one embodiment of a layout of a game of chance constructed in accordance with several features of the present general inventive concept.

FIG. 1A illustrates one embodiment of a game of chance 10. The game of chance, or game, is identified as 10 herein and in the accompanying figures. Referring to FIG. 1A, the game 10 is played on a network device with one or more processors with a game application using a game layout 18 (hereinafter layout 18) defined by plural cells 16 which, are arranged into a pre-determined layout shape.

For example, one embodiment the pre-determined layout shape includes are a grid of rows 12 and columns 14 comprising a square or rectangular shape. However, the present invention is not limited to such an embodiment and other layouts and other shapes may be used to practice the invention.

Figure 1B:
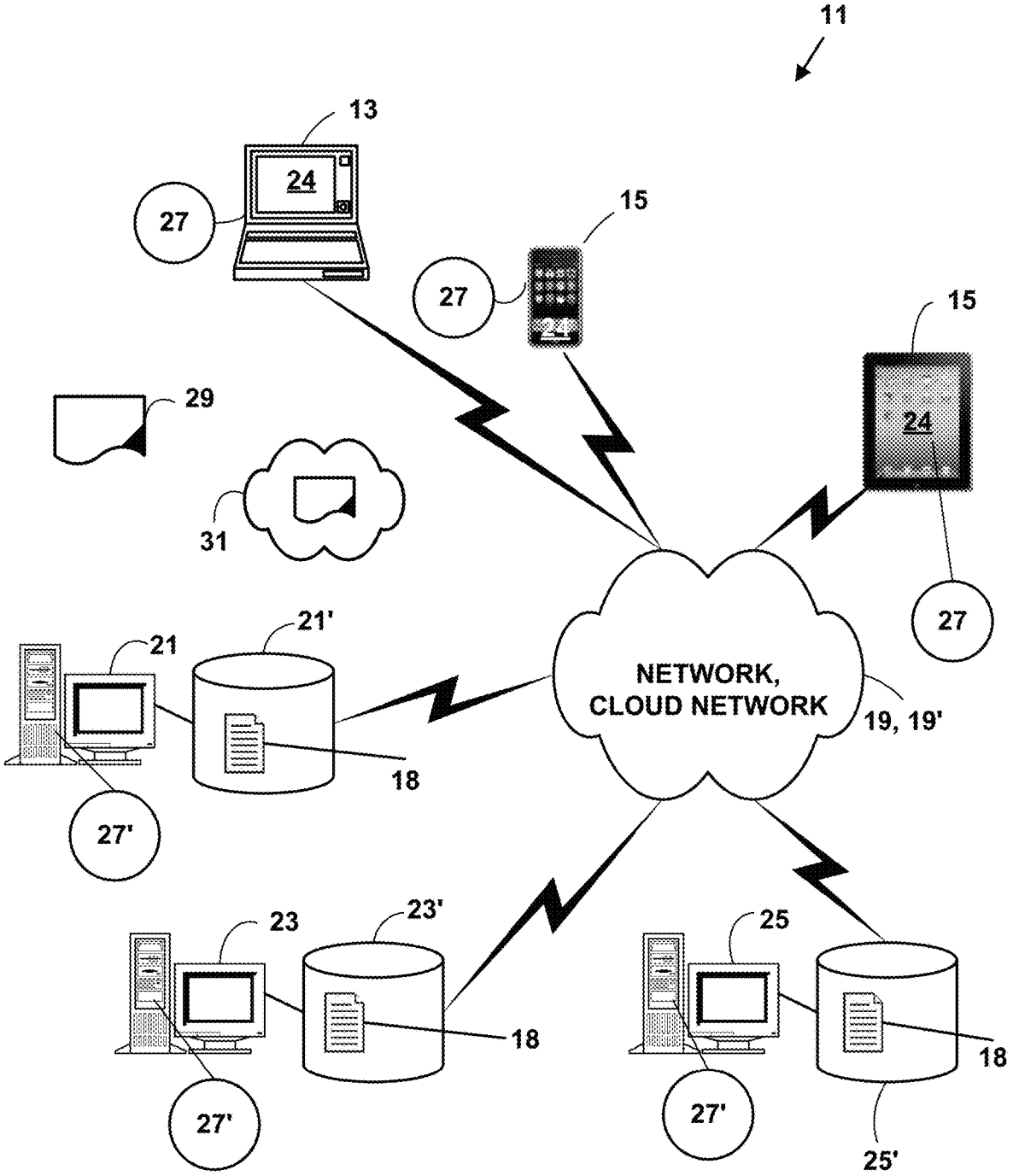
FIG. 1B is a block diagram illustrating an exemplary game of chance playing system.

FIG. 1B is a block diagram illustrating an exemplary game of chance playing system 11. The exemplary gaming system 11 includes, but is not limited to, one or more target network devices 13, 15, 17, (only three of which are illustrated) each with one or more processors. The target network devices 13, 15, 17, include, but are not limited to, wearable devices (e.g., glasses, watches, wrist bands, smart clothing, jewelry, etc.), mobile phones, non-mobile phones, smart phones, tablet computers, portable video gaming platforms (GAMEBOY and DSI by Nintendo, PSP by Sony, etc.), non-portable gaming platforms (e.g., XBOX by Microsoft, Wii by Nintendo, PLAY STATION, by Sony, gambling machines, etc.) non-mobile computers, wireless devices, wired devices, video gambling devices, laptop computers, personal information devices, personal digital/data assistants (PDA), hand-held devices, network appliances, televisions, kiosks, Internet appliances, cable television set-top boxes, Internet television set-top boxes, satellite television boxes, cellular telephones that are capable of data communications, etc.

However, the present invention is not limited to these target electronic devices 13, 15, 17 and more, fewer or others types of target electronic devices can also be used. The target network devices 13, 15, 17 function as client devices in some instances and server devices in other instances. The target network devices 13, 15, 17 include wireless or wired communications interfaces to communicate with a communications network 19.

The communications network 19 includes, but is not limited to, the Internet, an intranet, a wired Local Area Network (LAN), a wireless LAN (WiLAN), a Wide Area Network (WAN), a Metropolitan Area Network (MAN), Public Switched Telephone Network (PSTN), mesh networks, Bluetooth networks, cloud and/or other types and combinations of wired 19' and wireless communications networks 19 providing voice, video and data communications with wired or wireless communication protocols.

In one embodiment, the communications network 19 includes a cloud communications network 19' comprising plural different cloud component networks, a public (e.g. Internet, PSTN, etc.), private (e.g., LAN, WAN, etc.), hybrid (e.g., Internet plus private LAN, etc.), and/or community (e.g., Internet plus, private LAN, plus PSTN, etc.) networks.

"Cloud computing" is a model for enabling, on-demand network access to a shared pool of configurable computing resources (e.g., public and private networks, servers, storage, applications, and services) that are shared, rapidly provisioned and released with minimal management effort or service provider interaction. The cloud communications network 19' provides emergency location of mobile network devices and automated vehicles as cloud services.

This exemplary cloud computing model for emergency location services promotes availability for shared resources and comprises: (1) cloud computing essential characteristics; (2) cloud computing service models; and (3) cloud computing deployment models. However, the present invention is not limited to this cloud computing model and other cloud computing models can also be used to practice the invention.

Exemplary cloud computing essential characteristics appear in Table 1. However, the present invention is not limited to these essential characteristics and more, fewer or other characteristics can also be used to practice the invention.

TABLE 1

| |
|---|
| 1. On-demand game playing services. Game player servers 21, 23, 25 can unilaterally provision computing capabilities, such as server time and network storage, as needed automatically without requiring human interaction with each network server on the cloud communications network 19'. |
| 2. Broadband network access. Gaming service capabilities are available to the target network devices 13, 15, 17 over plural broadband communications networks and accessed through standard mechanisms that promote use by heterogeneous thin or thick client platforms. The broadband network access includes high speed network access such as 3G and/or 4G and/or 5G wireless and/or wired and broadband and/or ultra-broad band (e.g., WiMAX, etc.) network access. |
| 3. Resource pooling. Game playing computing resources are pooled to serve multiple requester target network devices 13, 17, 17, using a multi-tenant model, with different physical and virtual resources dynamically assigned and reassigned according to gaming demand. There is location independence in that a requester of game playing services has no control and/or knowledge over the exact location of the provided by the game playing resources but may be able to specify location at a higher level of abstraction. Examples of pooled resources include storage, processing, memory, network bandwidth, virtual server network device and virtual target network devices. |
| 4. Rapid elasticity. Capabilities can be rapidly and elastically provisioned, in some cases automatically, to quickly scale out and rapidly released to quickly scale for game playing services played by a large number of players. To the game playing system providers, the game playing service capabilities available for provisioning appear to be unlimited and can be used in any quantity at any time. |
| 5. Measured Services. Cloud computing systems automatically control and optimize resource use by leveraging a metering capability at some level of abstraction appropriate to the type of game playing services. Game playing service usage is monitored, controlled, and reported providing transparency for both game player service providers and the game players. |

Plural server network devices 21, 23, 25 (only three of which are illustrated) each with one or more processors and include one or more associated databases 21', 23', 25'. The plural server network devices 21, 23, 25 are in communications with the one or more target network devices 13, 15, 17 via the communications network 19. The plural server network devices 21, 23, 25 include, but are not limited to, wireless or wired or data communications servers, wireless access points, proxy servers and other types of server devices.

The communications network 19 may include one or more gateways, routers, bridges, switches. A gateway connects computer networks using different network protocols and/or operating at different transmission capacities. A router receives transmitted messages and forwards them to their correct destinations over the most efficient available route. A bridge is a device that connects networks using the same communications protocols so that information can be passed from one network device to another. A switch is a device that filters and forwards packets between network segments. Switches typically operate at the data link layer and sometimes the network layer and therefore support virtually any packet protocol.

An operating environment for the network devices 13, 15, 17, 21, 23, 25 and interfaces of the present invention include a processing system with one or more high speed Central Processing Unit(s) ("CPU") or other types of processors and a memory. In accordance with the practices of persons skilled in the art of computer programming, the present invention is described below with reference to acts and symbolic representations of operations or instructions that are performed by the processing system, unless indicated otherwise. Such acts and operations or instructions are referred to as being "computer-executed," "CPU executed" or "processor executed."

It will be appreciated that acts and symbolically represented operations or instructions include the manipulation of electrical signals by the CPU. An electrical system represents data bits which cause a resulting transformation or reduction of the electrical signals, and the maintenance of data bits at memory locations in a memory system to thereby reconfigure or otherwise alter the CPU's operation, as well as other processing of signals. The memory locations where data bits are maintained are physical locations that have particular electrical, magnetic, optical, or organic properties corresponding to the data bits.

The data bits may also be maintained on a non-transitory computer readable medium including magnetic disks, optical disks, organic memory, and any other volatile (e.g., Random Access Memory ("RAM")) or non-volatile (e.g., Read-Only Memory ("ROM")) mass storage system readable by the CPU. The non-transitory computer readable medium includes cooperating or interconnected non-transitory computer readable medium, which exist exclusively on the processing system or be distributed among multiple interconnected processing systems that may be local or remote to the processing system. In one embodiment, the data bits are stored with one or more encryption and/or security methods described herein.

In one embodiment one or more target network devices 13, 15, 17 and one or and/or the one or more server network devices 21, 23, 25 communicate with each other and other network devices with near field communications (NFC) and/or machine-to-machine (M2M) communications.

"Near field communication (NFC)" is a set of standards for smartphones and similar devices to establish radio communication with each other by touching them together or bringing them into close proximity, usually no more than a few centimeters. Present and anticipated applications include contactless transactions, data exchange, and simplified setup of more complex communications such as Wi-Fi. Communication is also possible between an NFC device and an unpowered NFC chip, called a "tag" including radio frequency identifier (RFID) tags.

NFC standards cover communications protocols and data exchange formats, and are based on existing radio-frequency identification (RFID) standards including ISO/IEC 14443 and FeliCa. These standards include ISO/IEC 1809 and those defined by the NFC Forum, all of which are incorporated by reference.

"Machine to machine (M2M)" refers to technologies that allow both wireless and wired systems to communicate with other devices of the same ability. M2M uses a device to capture an event (such as option purchase, etc.), which is relayed through a network (wireless, wired cloud, etc.) to an application (software program), that translates the captured event into meaningful information. Such communication was originally accomplished by having a remote network of machines relay information back to a central hub for analysis, which would then be rerouted into a system like a personal computer.

However, modern M2M communication has expanded beyond a one-to-one connection and changed into a system of networks that transmits data many-to-one and many-to-many to plural different types of devices and appliances. The expansion of IP networks across the world has made it far easier for M2M communication to take place and has lessened the amount of power and time necessary for information to be communicated between machines.

The communications network 19 may also include one or more servers or access points (AP) including wired and wireless access points (WiAP).

The communications network 19 includes data networks using the Transmission Control Protocol (TCP), User Datagram Protocol (UDP), Internet Protocol UP) and other data protocols.

The communications network 19 may also include wired interfaces connecting portions of a PSTN or cable television network that connect the target network devices 13, 15, 17 via the Public Switched Telephone Network (PSTN) or a cable television network (CATV) including high definition television (HDTV) that connect the target network devices 13, 15, 17 via one or more twisted pairs of copper wires, digital subscriber lines (e.g. DSL, ADSL, VDSL, etc.) coaxial cable, fiber optic cable, other connection media or other connection interfaces. The PSTN is any public switched telephone network provided by AT&T, CenturyLink, FairPoint, Frontier, Sprint, Verizon, and other Local Exchange Carriers, etc.

The communications network 19 may also include digital and analog cellular services, Commercial Mobile Radio Services (CMRS), including, mobile radio, paging and other wireless services. The communications network 18 includes a cellular telephone network, Personal Communications Services network ("PCS"), Packet Cellular Network ("PCN"), Global System for Mobile Communications, ("GSM"), Generic Packet Radio Services ("GPRS"), Cellular Digital Packet Data ("CDPD"). The communications network 18 includes a Wireless Application Protocol ("WAP") or Digital Audio Broadcasting ("DAB"), 802.xx.xx, Global Positioning System ("GPS") and GPS map, Digital GPS ("DGPS") or other type of wireless network.

The wireless network includes, but is not limited to Code Division Multiple Access ("CDMA"), Time Division Multiple Access ("TDMA"), 3G, 4G, 5G, LTE and/or other switched wireless technologies.

PCS networks include network that cover a range of wireless, digital communications technologies and services, including cordless phones, mobile phones, voice mail, paging, faxing, mobile personal PDAs, etc. PCS devices are typically divided into narrowband and broadband categories.

Narrowband devices which operate in the 900 MHz band of frequencies, typically provide paging, data messaging, faxing, and one- and two-way electronic messaging capabilities. Broadband devices, which operate in the 1850 MHz to 1990 MHz range typically provide two-way voice, data, and video communications. Other wireless technologies such as GSM, CDMA and TDMA are typically included in the PCS category.

GSM is another type of digital wireless technology widely used throughout Europe, in Australia, India, Africa, Asia, and the Middle East. GSM use is growing in the U.S. GSM is a wireless platform based on TDMA to digitize data. GSM includes not only telephony and Short Message Services ("SMS") but also voice mail, call forwarding, fax, caller ID, Internet access, and e-mail.

However, present invention is not limited to the frequencies and/or bandwidths described and slower, faster and other frequencies and/or bandwidths currently know or to be developed can be used to practice the invention.

SMS or "text messaging" is type of communications service that enables a user to allow private message communications with another user. GSM typically operates at three frequency ranges: 900 MHz (GSM 900) in Europe, Asia and most of the rest of the world; 1800 MHz (GSM 1800 or DCS 1800 or DCS) in a few European countries; and 1900 MHz (GSM 1900 also called PCS 1900 or PCS) in the United States. GSM also operates in a dual-band mode including 900/1800 MHz and a tri-band mode include 900/1800/1900 Mhz.

Short Message Service (SMS) is a text messaging service component of phone, Web, or mobile communication systems. It uses standardized communications protocols to allow fixed line or mobile phone or wearable mobile devices to exchange short text messages.

SMS as used on modern handsets originated from radio telegraphy in radio memo pagers using standardized phone protocols. These were defined in 1985 as part of the GSM series of standards as a means of sending messages of up to 160 characters to and from GSM mobile handsets. Though most SMS messages are mobile-to-mobile text messages, support for the service has expanded to include other mobile technologies, such as CDMA networks, as well as satellite and landline networks.

GPRS is a standard for wireless communications, which runs at speeds up to 150 kilo-bits-per-second ("kbit/s"). GPRS, which supports a wide range of bandwidths is an efficient use of limited bandwidth and is particularly suited for sending and receiving small bursts of data such as e-mail and Web browsing, as well as large volumes of data.

CDPD is a wireless standard providing two-way, 19.2-Kbps or higher packet data transmission over existing cellular telephone channels. A Packet Cellular Network ("PCN") includes various types of packetized cellular data.

The communications network 19 may also include a "mesh network" or a "mesh sensor network." A mesh network is a self-organizing networks built from plural nodes that may spontaneously create an impromptu network, assemble the network themselves, dynamically adapt to device failure and degradation, manage movement of nodes, and react to changes in task and network requirements. The plural nodes are reconfigurable smart sensor nodes that are self-aware, self-reconfigurable and autonomous.

A mesh network is a network that employs one of two connection arrangements, full mesh topology or partial mesh topology. In the full mesh topology, each node is connected directly to each of the others. In the partial mesh topology, nodes are connected to only some, not all, of the other nodes. A mesh network is a network where the nodes are in close proximity (e.g., about few feet to about 100 feet, or about 1 meter to about 30 meters, etc.).

Preferred embodiments of the present invention include network devices and interfaces that are compliant with all or part of standards proposed by the Institute of Electrical and Electronic Engineers (IEEE), International Telecommunications Union-Telecommunication Standardization Sector (ITU), European Telecommunications Standards Institute (ETSI), Internet Engineering Task Force (IETF), U.S. National Institute of Security Technology (NIST), American National Standard Institute (ANSI), Wireless Application Protocol (WAP) Forum, Data Over Cable Service Interface Specification (DOCSIS) Forum, Bluetooth Forum, the ADSL Forum, the Federal Communications Commission (FCC), the 3rd Generation Partnership Project (3GPP), and 3GPP Project 2, (3GPP2) and Open Mobile Alliance (OMA). However, network devices based on other standards could also be used.

The Open Systems Interconnection ("OSI") reference model is a layered architecture that standardizes levels of service and types of interaction for network devices exchanging information through a communications network. The OSI reference model separates network device-to-network device communications into seven protocol layers, or levels, each building- and relying—upon the standards contained in the levels below it. The OSI reference model includes from lowest-to-highest, a physical, data-link, network, transport, session, presentation and application layer. The lowest of the seven layers deals solely with hardware links; the highest deals with software interactions at the application-program level.

The Internet Protocol reference model is a layered architecture that standardizes levels of service for the Internet Protocol suite of protocols. The Internet Protocol reference model comprises in general from lowest-to-highest, a link, network, transport and application layer.

In one embodiment of the present invention, the wireless and/or wired interfaces used for the plural target network devices 13, 15, 17 and/or server network devices 23, 25, 27 include but are not limited to, an IEEE 802.11a, 802.11ac, 802.11b, 802.11g, 802.11n, "Wireless Fidelity" ("Wi-Fi"), Wi-Fi Aware, "Worldwide Interoperability for Microwave Access" ("WiMAX"), ETSI High Performance Radio Metropolitan Area Network (HIPERMAN), "RF Home" Zigbee, Bluetooth, Infrared, Industrial, Scientific and Medical (ISM), a Radio Frequency Identifier (RFID), Real-Time Text (RTT), or other long range or short range wireless and/or wired interfaces may be used to practice the invention.

802.11b defines a short-range wireless network interface. The IEEE 802.11b standard defines wireless interfaces that provide up to 11 Mbps wireless data transmission to and from wireless devices over short ranges. 802.11a is an extension of the 802.11b and can deliver speeds up to 54 M bps. 802.11g deliver speeds on par with 802.11a. However, other 802.11xx interfaces can also be used and the present invention is not limited to the 802.11 protocols defined. The IEEE 802.11a, 802.11an, 802.11b, 802.11g and 802.11n standards are incorporated herein by reference.

Wi-Fi is another type of 802.11xx interface, whether 802.11b, 802.11a, dual-band, etc. Wi-Fi devices include an RF interfaces such as 2.4 GHz for 802.11b or 802.11g and 5 GHz for 802.11a.

Wi-Fi Aware is a new capability for energy-efficient, proximity-based service discovery among Wi-Fi capable devices. The technology in Wi-Fi Aware enables network devices to discover other devices, applications, and information nearby before making a Wi-Fi connection. Wi-Fi Aware makes contextual awareness more immediate and useful, enabling personalized applications (e.g., 26, 26', etc.) that continuously scan surroundings, anticipate actions, and notify of services and selected preferences. Wi-Fi Aware devices go through a process of discovery and synchronization, establishing a common "heartbeat" that enables very power efficient operation. Devices form clusters and exchange small messages about services available nearby, enabling immediate discovery. Wi-Fi Aware's ability to send and receive tiny messages before establishing a network 19, 19' connection further enables a two-way conversation among network devices in emergency and non-emergency situations whose current physical geographic locations and/or 2D/3D geo-space information may be known and available. This capability not only enables a network device to discover nearby information and services, but request additional information, such as emergency location information—all without establishing, an Internet, PSTN, or other network connections 19, 19'. The Wi-Fi Aware reference document, wp_Wi-Fi_Aware_Industry_20150714_v2, Jul. 14, 2015, is incorporated herein by reference.

In one embodiment, the applications 26, 26' include Wi-Fi Aware capabilities. In one embodiment the wireless interfaces include Wi-Fi Aware wireless interface capabilities. However, the present invention is not limited to these embodiments and the invention can be practiced without Wi-Fi Aware capabilities.

WiMAX is an industry trade organization formed by communications component and equipment companies to promote and certify compatibility and interoperability of broadband wireless access equipment that conforms to the IEEE 802.16xx and ETSI HIPERMAN. HIPERMAN is the European standard for MANs.

The IEEE The 802.16a, 802.16c, 802.16d 802.16e and 802.16g standards are wireless MAN technology standard that provides a wireless alternative to cable, DSL and T1/E1 for last mile broadband access. It is also used as complimentary technology to connect IEEE 802.11xx hot spots to the Internet.

The IEEE 802.16a standard for 2-11 GHz is a wireless MAN technology that provides broadband wireless connectivity to fixed, portable and nomadic devices. It provides up to 50-kilometers of service area range, allows users to get broadband connectivity without needing direct line of sight with the base station, and provides total data rates of up to 280 Mbps per base station, which is enough bandwidth to simultaneously support hundreds of businesses with T1/E1-type connectivity and thousands of homes with DSL-type connectivity with a single base station. The IEEE 802.16g provides up to 100 Mbps.

The IEEE 802.16e standard is an extension to the approved IEEE 802.16/16a/16g standard. The purpose of 802.16e is to add limited mobility to the current standard which is designed for fixed operation.

The ESTI HIPERMAN standard is an interoperable broadband fixed wireless access standard for systems operating at radio frequencies between 2 GHz and 11 GHz.

The IEEE 802.16a, 802.16d, 802.16e and 802.16g standards are incorporated herein by reference. More information on WiMAX can be found at the URL "www.wimaxforum.org." WiMAX can be used to provide a wireless local loop (WLP).

The ETSI HIPERMAN standards TR 101 031, TR 101 475, TR 101 493-1 through TR 101 493-3, TR 101 761-1 through TR 101 761-4, TR 101 762, TR 101 763-1 through TR 101 763-3 and TR 101 957 are incorporated herein by reference. More information on ETSI standards can be found at the URL "www.etsi.org."

IEEE 802.15.4 (Zigbee) is low data rate network standard used for mesh network devices such as sensors, interactive toys, smart badges, remote controls, and home automation. The 802.15.4 standard provides data rates of 250 kbps, 40 kbps, and 20 kbps, two addressing modes; 16-bit short and 64-bit IEEE addressing, support for critical latency devices, such as joysticks, Carrier Sense Multiple Access/Collision Avoidance, (CSMA-CA) channel access, automatic network establishment by a coordinator, fully handshaked protocol for transfer reliability, power management to ensure low power consumption for multi-month to multi-year battery usage and up to 16 channels in the 2.4 GHz ISM band (Worldwide), 10 channels in the 915 MHz (US) and one channel in the 868 MHz band (Europe). The IEEE 802.15.4-2003 standard is incorporated herein by reference. More information on 802.15.4 and ZigBee can be found at the URL "www.ieee802.org" and "www.zigbee.org" respectively.

Bluetooth (IEEE 802.15.1a) is a short-range radio frequency technology aimed at simplifying communications among network devices and between network devices. Bluetooth wireless technology supports both short-range point-to-point and point-to-multipoint connections. The Bluetooth Specification, GL 11r02, March 2005, prepared by the Bluetooth SIG, Inc. and the IEEE 802.15.1a standard are incorporated herein by reference.

Infra data association (IrDA) is a short-range radio wireless Bluetooth or wireless infrared communications. Industrial, Scientific and Medical (ISM) are short-range radio wireless communications interfaces operating at 400 MHz, 800 MHz, and 900 Mhz. ISM sensors may be used to provide wireless information to practice the invention.

An RFID is an automatic identification method, relying on storing and remotely retrieving data using devices called RFID tags or transponders. An RFID tag is a small object that can be attached to or incorporated into a product, animal, or person. RFID tags contain antennas to enable them to receive and respond to radio-frequency queries from an RFID transceiver. Passive tags require no internal power source, whereas active tags require a power source. RFID sensors and/or RFID tags are used to provide wireless information to practice the invention.

Passive tags are powered by received radiation from a reading device and require no internal source of power; thus, they can be manufactured at very low cost and require no ongoing maintenance as long as they are not removed or physically damaged. Passive tags can only be read by a reader device in close proximity to the tag, which is an advantage in RFID-based in-building location services.

RFID Passive tags can be manufactured in a sticker-like form factor and held in place by adhesive, providing very low installation cost; however, such an arrangement is not heat-resistant, and conventional mechanical mounting employing screws or cover plates is advisable for at least a minimal subset of all installed tags.

RFID Passive tags are typically capable of providing a 96-bit number to a tag reader: 96 bits allow $2^{96}=10^{29}$ (100 billion billion billion) possible codes, ample to allow unique identification of every significant location within a building.

RFID active tags may also be employed for location awareness. Active tags have longer range and can include more sophisticated functionality. In the context of this invention, active tags may be programmed to validate their location from time to time, either by reference to Global Positioning System (GPS) signals using very long integration times, or by interrogation of other RFID tags in their vicinity.

A RFID tag which finds itself in an incorrect or unverified location is programmed to turn itself off, thus avoiding spurious location data being provided to a user; responses to incorrect location may also include emitting a distress signal which can be detected by a reader during building maintenance, or contacting a central location by direct wireless communications or mesh networking employing the multiplicity of companion ID tags, in order to induce maintenance personnel to diagnose and repair the problem with the subject tag.

RFID Active tags are also deployed in a mesh network that would allow information to pass from tag to tag. This type of network would allow tag and reader information to be passed from location to location and possibly from floor to floor to move the information to a central location or to the building wall ultimately making it easier to access. Active tag networks have significant functional advantages, but are relatively expensive and maintenance-intensive compared to passive tags.

Real-Time Text (RTT) is text transmitted instantly as it is being typed or created. Recipients can immediately read the message while it is being written, without waiting. Real-time text is used for conversational text, in collaboration, and in live captioning. RTT technologies include TDD/TTY devices for the deaf, live captioning for TV, a feature enhancement in instant messaging, captioning for telephony/video teleconferencing, telecommunications relay services including Internet Protocol-relay, transcription services including Remote CART, Type Well, collaborative text editing, streaming text applications, and next-generation 9-1-1/1-1-2 emergency services.

The target network devices 13, 15, 17 and/or one or more server network devices 23, 25, 27 include a protocol stack with multiple layers based on the Internet Protocol or OSI reference model. The protocol stack is used for, but not limited to, data networking. The protocol stack includes, but is not limited to, TCP, UDP, IP, Hypertext Transfer Protocol (HTTP), Simple Mail Transfer Protocol (SMTP), Post Office Protocol version 3 (POP3), Internet Mail Access Protocol (IMAP), Voice-Over-IP (VoIP), Session Initiation Protocol (SIP), Service Location Protocol (SLP), Session Description Protocol (SDP), Real-time Protocol (RTP), H.323, H.324, Domain Name System (DNS), Authentication Authorization and Accounting (AAA), instant-messaging (TM), Text-over-IP (ToIP), Internet Protocol version 4 (IPv4), Internet Protocol Version 6 (IPv6), Hybrid dual-stack IPv6/IPv4 and other protocols.

TCP provides a connection-oriented, end-to-end reliable protocol designed to fit into a layered hierarchy of protocols that support multi-network applications. For more information on TCP 58 see IETF RFC-793, incorporated herein by reference.

UDP provides a connectionless mode of communications with datagrams in an interconnected set of networks. For more information on UDP see ITEF RFC-768, incorporated herein by reference.

IP is an addressing protocol designed to route traffic within a network or between networks. For more information on IP 54 see IETF RFC-791, incorporated herein by reference. An IP address includes four sets of numbers divided by period (e.g., x.x.x.x) in the range of zero to 255. An IP address is a unique string of numbers that identifies a device on an IP based network.

HTTP is a standard protocol for communications on the World Wide Web. For more information on HTTP, see IETF RFC-2616, incorporated herein by reference.

SMTP is a protocol for sending e-mail messages between devices including e-mail servers. For more information on SMTP, see IETF RFC-821 and RFC-2821, incorporated herein by reference.

POP3 is a protocol for a protocol used to retrieve e-mail from a mail server. For more information on POP3, see IETF RFC-1939, incorporated herein by reference.

IMAP is a protocol for retrieving e-mail messages from a server. For more information on IMAP, see IETF RFC-1730, incorporated herein by reference.

Media Access Control (MAC) is a data link layer protocol. A MAC address is a physical address of a device connected to a communications network, expressed as a 48-bit hexadecimal number. A MAC address is permanently assigned to each unit of most types of networking hardware, such as network interface cards (NICs) (e.g., Ethernet cards, etc.) by manufacturers at the factory.

VoIP is a set of facilities for managing the delivery of voice information using IP 28 packets. In general, VoIP is used to send voice information in digital form in discrete data packets (i.e., IP 28 packets) over data networks 18 rather than using traditional circuit-switched protocols used on the PSTN. VoIP is used on both wireless and wired data networks.

VoIP typically comprises several applications (e.g., SIP, SLP, SDP, H.323, H.324, DNS, AAA, etc.) that convert a voice signal into a stream of packets (e.g., IP 28 packets) on a packet network and back again. VoIP allows voice signals to travel over a stream of data packets over a communications network 18.

SIP supports user mobility by proxying and re-directing requests to a mobile node's current location. Mobile nodes can register their current location. SIP is not tied to any particular conference control protocol. SIP is designed to be independent of a lower-layer transport protocol and can be extended. For more information on SIP, see IETF RFC-2543 and IETF 3261, the contents of both of which are incorporated herein by reference.

SLP provides a scalable framework for the discovery and selection of network services. Using SLP, network devices using the Internet need little or no static configuration of network services for network based applications. For more information on SLP see IETF RFC-2608, incorporated herein by reference.

SDP is a protocol for describing multimedia sessions for the purposes of session announcement, session invitation, and other forms of multimedia session initiation. For more information on SDP, see IETF RFC-2327, incorporated herein by reference.

RTP is a protocol for end-to-end network transport functions suitable for applications transmitting real-time data, such as audio, video or simulation data, over multicast or unicast network services. For more information on RTP, see IETF RFC-1889, incorporated herein by reference.

H.323 is one of main family of video conferencing recommendations for IP networks. The ITU-T H.323 standards entitled "Packet-based multimedia communications systems" dated 02/98, 09/99, 11/00 and 07/03 are incorporated herein by reference.

H.324 is a video conferencing recommendation using Plain Old Telephone Service (POTS) lines. The ITU-T H.324 standards entitled "Terminal for low bit-rate multimedia communication" dated 02/98 and 03/02 are incorporated herein by reference.

A Domain Name System (DNS) provides replicated distributed secure hierarchical databases that hierarchically store resource records under domain names. For more information on the DNS see IETF RFC-1034, RFC-1035, RFC-1591, RFC-2606 and RFC-2929, the contents of all of which are incorporated herein by reference.

Authentication Authorization and Accounting (AAA) includes a classification scheme and exchange format for accounting data records (e.g., for call billing, etc.). For more information on AAA applications, see, IETF RFC-2924, the contents of which are incorporated herein by reference.

VoIP services typically need to be able to connect to traditional circuit-switched voice networks such as those provided by the PSTN. Thus, VoIP is typically used with the H.323 protocol and other multimedia protocols. H.323 and H.324 terminals such as multimedia computers, handheld devices, PDAs or other devices such as non-mobile and mobile phones connect to existing wired and wireless communications networks 18 as well as private wired and wireless networks.

H.323 and H.324 terminals implement voice transmission functions and typically include at least one voice codec (e.g., ITU-T CODECS, G.711, G.723, G.726, G.728, G.729, GSM, etc.) that sends and receives packetized voice data and typically at least one video codec (e.g., MPEG, etc.) that sends and receives packetized video data).

An Instant Message (IM) is a "short," real-time or near-real-time message that is sent between two or more end user devices such (computers, personal digital/data assistants (PDAs) mobile phones, etc.) running IM client applications. An IM is typically a short textual message. Examples of IM messages include America Online's Instant (AIM) messaging service, Microsoft Network (MSN) Messenger, Yahoo Messenger, and Lycos ICQ Instant Messenger, IM services provided by telecom providers such as T-Mobile, Verizon, Sprint, and others that provide IM services via the Internet and other wired and wireless communications networks. In one embodiment of the present invention, the IM protocols used meet the requirements of Internet Engineering Task Force (IETF) Request For Comments (RFC)-2779, entitled "Instant Messaging/Presence Protocol Requirements." However, the present invention is not limited to such an embodiment and other IM protocols not compliant with IETF RFC 2779 may also be used.

Text-over-IP (ToIP) is defined IETF RFC 5194, the contents of which are incorporated herein by reference. ToIP is a framework for implementation of all required functions based on the Session Initiation Protocol (SIP) and the Real-Time Transport Protocol (RTP. This ToIP framework is specifically designed to be compatible with Voice-over-IP (VoIP), Video-over-IP, and Multimedia-over-IP (MoIP) environments. This ToIP framework also builds upon, and is compatible with, the high-level user requirements of deaf, hard-of-hearing and speech-impaired users as described in IETF RFC 3351. It also meets real-time text requirements of mainstream users. ToIP also offers an IP equivalent of analog text telephony services as used by deaf, hard-of-hearing, speech-impaired, and mainstream users. The Session Initiation Protocol (SIP) is the protocol of choice for all the necessary control and signaling required for the ToIP framework.

Internet Protocol version 6 (IPv6) is the latest version of the Internet Protocol (IP), the communications protocol that provides an identification and location system for computers on networks and routes traffic across the Internet. IPv6 was developed by the IETF to deal with the long-anticipated problem of IPv4 address exhaustion. IPv6 is described in IETF RFC 2460, incorporated herein by reference. IPv6 uses a 128-bit address, allowing $2^{128}$, or approximately $3.4\times10^{38}$ addresses, or more than $7.9\times10^{28}$ times as many as IPv4, which uses 32-bit addresses. IPv4 provides approximately 4.3 billion addresses.

Internet Protocol Version 4 (IPv4) betas the first publicly used version of the Internet Protocol. IPv4 was developed as a research project by the Defense Advanced Research Projects Agency (DARPA), a United States Department of Defense agency, before becoming the foundation for the Internet and the World Wide Web. It is currently described by IETF publication RFC 791 (September 1981), the contents of which is incorporated by reference, which replaced an earlier definition (RFC 760, January 1980), IPv4 included an addressing system that used numerical identifiers consisting of 32 bits.

Hybrid dual-stack IPv6/IPv4 implementations recognize a special class of addresses, the IPv4-mapped IPv6 addresses. In these addresses, the first 80 bits are zero, the next 16 bits are one, and the remaining 32 bits are the IPv4 address.

Television Services

In one embodiment, the game application 27 provides gaming services from television services via the communications network 19, 19'. These television services include digital television services, including, but not limited to, cable television, satellite television, high-definition television, three-dimensional, televisions and other types of network devices.

However, the present invention is not limited to such television services and more, fewer and/or other television services can be used to practice the invention.

Internet Television Services

In one embodiment, the game application 27 provides game playing services from various Internet based television services via the communications network 19, 19'. The television services include Internet television, Web-TV, and/or Internet Protocol Television (IPTV) and/or other broadcast television services.

"Internet television" allows users to choose a program or the television show they want to watch from an archive of programs or from a channel directory. The two forms of viewing Internet television are streaming content directly to a media player or simply downloading a program to a viewer's set-top box, game console, computer, or other mesh network device.

"Web-TV" delivers digital content via non-mesh broadband and mobile networks. The digital content is streamed to a viewer's set-top box, game console, computer, or other mesh network device.

"Internet Protocol television (IPTV)" is a system through which Internet television services are delivered using the architecture and networking methods of the Internet Protocol Suite over a packet-switched network infrastructure, e.g., the Internet and broadband Internet access networks, instead of being delivered through traditional radio frequency broadcast, satellite signal, and cable television formats.

However, the present invention is not limited to such Internet Television services and more, fewer and/or other Internet Television services can be used to practice the invention.

Social Networking Services

In one embodiment, the game application 27 provides game playing services from various social network services via the communications network 19, 19' to/from one or more social networking web-sites and/or applications (e.g., FACEBOOK, LINKEDIN, SNAPCHAT, YOUTUBE, TWITTER, MY-SPACE, MATCH.COM, E-HARMONY, GROUPON, SOCIAL LIVING, PINTREST, INSTAGRAM, etc.). The social networking web-sites also include, but are not limited to, social couponing sites, dating web-sites, blogs, RSS feeds, and other types of information web-sites in which messages can be left or posted for a variety of social activities. Such social networking sites include plural different proprietary and public social networking communications protocols for communications between a user and the social networking sites. Such social networking protocols may be used to send emergency messages.

However, the present invention is not limited to the social networking services described and other public and private social networking services can also be used to practice the invention.

Security and Encryption

Network devices and interfaces of the present invention may include security and encryption for secure communications. Wireless Encryption Protocol (WEP) (also called "Wired Equivalent Privacy) is a security protocol for WiLANs defined in the IEEE 802.11b standard. WEP is cryptographic privacy algorithm, based on the Rivest Cipher 4 (RC4) encryption engine, used to provide confidentiality for 802.11b wireless data.

RC4 is cipher designed by RSA Data Security, Inc. of Bedford, Mass., which can accept encryption keys of arbitrary length, and is essentially a pseudo random number generator with an output of the generator being XORed with a data stream to produce encrypted data.

One problem with WEP is that it is used at the two lowest layers of the OSI model, the physical layer and the data link layer, therefore, it does not offer end-to-end security. One another problem with WEP is that its encryption keys are static rather than dynamic. To update WEP encryption keys, an individual has to manually update a WEP key. WEP also typically uses 40-bit static keys for encryption and thus provides "weak encryption," making a WEP device a target of hackers.

The IEEE 802.11 Working Group is working on a security upgrade for the 802.11 standard called "802.11i." This supplemental draft standard is intended to improve WiLAN security. It describes the encrypted transmission of data between systems 802.11X WiLANs. It also defines new encryption key protocols including the Temporal Key Integrity Protocol (TKIP). The IEEE 802.11i draft standard, version 4, completed Jun. 6, 2003, is incorporated herein by reference.

The 802.11i is based on 802.1x port-based authentication for user and device authentication. The 802.11i standard includes two main developments: Wi-Fi Protected Access (WPA) and Robust Security Network (RSN).

WPA uses the same RC4 underlying encryption algorithm as WEP. However, WPA uses TKIP to improve security of keys used with WEP. WPA keys are derived and rotated more often than WEP keys and thus provide additional security. WPA also adds a message-integrity-check function to prevent packet forgeries.

RSN uses dynamic negotiation of authentication and selectable encryption algorithms between wireless access points and wireless devices. The authentication schemes proposed in the draft standard include Extensible Authentication Protocol (EAP). One proposed encryption algorithm is an Advanced Encryption Standard (AES) encryption algorithm.

Dynamic negotiation of authentication and encryption algorithms lets RSN evolve with the state of the art in security, adding algorithms to address new threats and continuing to provide the security necessary to protect information that WiLANs carry.

The NIST developed a new encryption standard, the Advanced Encryption Standard (AES) to keep government information secure. AES is intended to be a stronger, more efficient successor to Triple Data Encryption Standard (3DES). More information on NIST AES can be found at the URL "www.nist.gov/aes."

DES is a popular symmetric-key encryption method developed in 1975 and standardized by ANSI in 1981 as ANSI X.3.92, the contents of which are incorporated herein by reference. 3DES is the encrypt-decrypt-encrypt (EDE) mode of the DES cipher algorithm. 3DES is defined in the ANSI standard, ANSI X9.52-1998, the contents of which are incorporated herein by reference. DES modes of operation are used in conjunction with the NIST Federal Information Processing Standard (FIPS) for data encryption (FIPS 46-3, October 1999), the contents of which are incorporated herein by reference.

The NIST approved a FIPS for the AES, FIPS-197. This standard specified "Rijndael" encryption as a FIPS-approved symmetric encryption algorithm that may be used by U.S. Government organizations (and others) to protect sensitive information. The NIST FIPS-197 standard (AES FIPS PUB 197, November 2001) is incorporated herein by reference.

The NIST approved a FIPS for U.S. Federal Government requirements for information technology products for sensitive but unclassified (SBU) communications. The NIST FIPS Security Requirements for Cryptographic Modules (FIPS PUB 140-2, May 2001) is incorporated herein by reference.

RSA is a public key encryption system which can be used both for encrypting messages and making digital signatures. The letters RSA stand for the names of the inventors: Rivest, Shamir and Adleman. For more information on RSA, see U.S. Pat. No. 4,405,829, now expired and incorporated herein by reference.

"Hashing" is the transformation of a string of characters into a usually shorter fixed-length value or key that represents the original string. Hashing is used to index and retrieve items in a database because it is faster to find the item using the shorter hashed key than to find it using the original value. It is also used in many encryption algorithms.

Secure Hash Algorithm (SHA), is used for computing a secure condensed representation of a data message or a data file. When a message of any length $<2^{64}$ bits is input, the SHA-1 produces a 160-bit output called a "message digest." The message digest can then be input to other security techniques such as encryption, a Digital Signature Algorithm (DSA) and others which generates or verifies a security mechanism for the message. SHA-512 outputs a 512-bit message digest. The Secure Hash Standard, FIPS PUB 180-1, Apr. 17, 1995, is incorporated herein by reference.

Message Digest-5 (MD-5) takes as input a message of arbitrary length and produces as output a 128-bit "message digest" of the input. The MD5 algorithm is intended for digital signature applications, where a large file must be "compressed" in a secure manner before being encrypted with a private (secret) key under a public-key cryptosystem such as RSA. The IETF RFC-1321, entitled "The MD5 Message-Digest Algorithm" is incorporated here by reference.

Providing a way to check the integrity of information transmitted over or stored in an unreliable medium such as a wireless network is a prime necessity in the world of open computing and communications. Mechanisms that provide such integrity check based on a secret key are called "message authentication codes" (MAC). Typically, message authentication codes are used between two parties that share a secret key in order to validate information transmitted between these parties.

Keyed Hashing for Message Authentication Codes (HMAC), is a mechanism for message authentication using cryptographic hash functions. HMAC is used with any iterative cryptographic hash function, e.g., MD5, SHA-1, SHA-512, etc. in combination with a secret shared key. The cryptographic strength of HMAC depends on the properties of the underlying hash function. The IETF RFC-2101, entitled "HMAC: Keyed-Hashing for Message Authentication" is incorporated here by reference.

An Electronic Code Book (ECB) is a mode of operation for a "block cipher," with the characteristic that each possible block of plaintext has a defined corresponding cipher text value and vice versa. In other words, the same plaintext value will always result in the same cipher text value. Electronic Code Book is used when a volume of plaintext is separated into several blocks of data, each of which is then encrypted independently of other blocks. The Electronic Code Book has the ability to support a separate encryption key for each block type.

Diffie and Hellman (DH) describe several different group methods for two parties to agree upon a shared secret in such a way that the secret will be unavailable to eavesdroppers. This secret is then converted into various types of cryptographic keys. A large number of the variants of the DH method exist including ANSI X9.42. The IETF RFC-2631, entitled "Diffie-Hellman Key Agreement Method" is incorporated here by reference.

However, the present invention is not limited to the security or encryption techniques described and other security or encryption techniques can also be used.

The HyperText Transport Protocol (HTTP) Secure (HTTPs), is a standard for encrypted communications on the World Wide Web. HTTPs is actually just HTTP over a Secure Sockets Layer (SSL). For more information on HTTP, see IETF RFC-2616 incorporated herein by reference.

The SSL protocol is a protocol layer which may be placed between a reliable connection-oriented network layer protocol (e.g. TCP/IP) and the application protocol layer (e.g. HTTP). SSL provides for secure communication between a source and destination by allowing mutual authentication, the use of digital signatures for integrity, and encryption for privacy.

The SSL protocol is designed to support a range of choices for specific security methods used for cryptography, message digests, and digital signatures. The security method are negotiated between the source and destination at the start of establishing a protocol session. The SSL 2.0 protocol specification, by Kipp E. B. Hickman, 1995, is incorporated herein by reference Transport Layer Security (TLS) provides communications privacy over the Internet. The protocol allows client/server applications to communicate over a transport layer (e.g., TCP) in a way that is designed to prevent eavesdropping, tampering, or message forgery. For more information on TLS see IETF RFC-2246, incorporated herein by reference.

In one embodiment, the target network device 13, 15, 17 includes a game application 27. In one embodiment, the game application 27 is a software application. However, the present invention is not limited to this embodiment and the game application 27 can be software, firmware, hardware and/or a combinations thereof.

In one embodiment, the game application 27 exists only on the network device 13, 15, 17. In another embodiment, game application 27' exists only on server network devices 21, 23, 25.

In another embodiment, a portion of the game application 27 exists on the network device 13, 15, 17 and another portion 27' exists one or more server network devices 21, 23, 25. However, the present invention is not limited to these embodiments and other embodiments and other combinations can also be used to practice the invention.

The game application 27 further includes wager control functionality 36 and verify game control functionality 34.

When the game 10 is initiated, as an automatic preprocessing step, the layout 18, is automatically allocated by the game application 27 into one or more data structures 29 in the non-transitory computer readable medium on the network device 13, 15, 17. A data structure 29 implements one or more particular Abstract Data Types (ADT), which specify the operations that can be performed on the one or more data structures 29 and the computational complexity of those operations. A data structure 29 is a physical implementation of an ADT in the non-transitory computer readable medium.

In one embodiment, layout 18 is automatically allocated by the game application 27 into plural cells 16 for a two-dimensional array comprising X-number of rows and Y-number of columns, where (X, Y) are a same integer value. In another embodiment, (X, Y) are different integer values.

In another embodiment, the layout 18 is automatically allocated by the game application 27 into plural cells for a three-dimensional array comprising X-number of rows, Y-number of columns and Z-number of unique games.

In another embodiment, the layout 18 is automatically allocated by the game application 27 into plural cells stored in one more cloud storage objects 31 on a cloud communications network 19'.

However, the present invention is not limited to these embodiments and other embodiments and other combinations can also be used to practice the invention.

The game application 27 also automatically includes plural instructions in the one or more data structures 29 and/or more or more cloud storage objects 31 verify game control functionality 34 and wager control functionality 36 for playing the game 10.

Each cell 16 (e.g., a row, column, (X, Y), etc.) in the layout 18 includes indicia 20, 22 indicating whether the cell is part of a winning combination of cells 16 of the game 10 or a non-winning combination of the cells 16 of the game 10.

For example, in the exemplary embodiment illustrated in FIG. 1, the layout 18 includes twenty-five cells 16 arranged into a grid of five rows 12 and five columns 14 or (12, 14). However, the present invention is not limited to this embodiments and more, fewer and/or other row and column based grid embodiments can be used to practice the invention.

After automatically allocating the layout 18 with the plural cells 16 into one or more data structures and/or cloud storage objects, the game application 27 automatically and randomly allocates N-number of winning indicia 20 and M-number of non-winning indicia 22 into the plural cells 16 in the layout 18, where the N-number of winning indicia is a pre-determined percentage of non-winning number of indicia 22.

In one embodiment, the game application 27 uses a random number generation and/or pseudo random number generation to determine a location of an individual cell 16 within the layout 18 in one or more data structures and/or cloud storage objects.

Random number generation is the generation of a sequence of numbers or symbols that cannot be reasonably predicted better than by a random chance, usually through a Random-Number Generator (RNG). A pseudorandom number generator (PRNG), also known as a Deterministic Random Bit Generator (DRBG), is a method for generating a sequence of numbers whose properties approximate the properties of sequences of random numbers.

However, the present invention is not limited to this embodiments and more, fewer and/or other methods can be used to determine a location of an individual cell 16 within the layout 18 in one or more data structures and/or cloud storage objects to practice the invention.

For example, as is illustrated by FIG. 1, five winning indicia 20 and twenty non-winning indicia 22 are distributed at random locations with the random number generator and/or with the pseudo-random number generator with respect to one another among the cells 16, with only one of the two types of indicia 20, 22 being included within each cell 16 in the layout. However, the present invention is not limited to this embodiment, and more, fewer and/or other numbers of winning indicia 20 and non-winning indicia 22 may be used to practice the invention.

In the embodiment illustrated in FIG. 1, the winning indicia 20 are each defined by an image of a star, while the non-winning indicia 22 are each defined by an image of a circle. However, it will be understood that numerous other types and designs of indicia may be used to designate winning 20 and non-winning indicia 22 to practice the invention without departing from the spirit and scope of the present invention.

In one embodiment, the game application 27 after determining a desired number of location of cells 16 with a winning indicia 20, the game application 27 automatically includes instructions for generating a desired image of a winning indicia 20 (e.g., star, etc.) in those cell 16 within the layout 18. After determining a desired number of location of cells 16 with a non-winning indicia 22, the game application 27 automatically includes instructions for generating a desired image of a non-winning indicia 20 (e.g., circle, etc.) in those cells 16 within the layout 18.

The game application 27 transforms each of the plural cells 16 from layout 18 stored in the one or more data structures and/or cloud storage objects for viewing and playing the game 10 by automatically displaying on a display component 24 of the network device 13, 15, 17, the plural cells 16 within the layout 18 with another image item 20*a* (e.g., arrow, FIG. 1, etc.) and/or instructional text that conceals actual contents of the plural cells 16 within the layout 16 (e.g., FIG. 6, item 22*d* with the text "Touch 3 windows, your choice?") instead of executing the instructions for generating the original image for the winning 20 or non-winning 22 indicia included in the plural cells 16 within the layout 18.

FIGS. 1-7 illustrate the display component 24 as computer monitor. However, the present invention is not limited to a computer monitor and any type of display component on and/or associated with, the network devices 13, 15, 17 and/or server network devices 21, 23, 25 can be used to practice the invention.

At the start of the game 10, the indicia 20, 22 within each cell 16 is initially concealed from the player by displaying from the game application 27 the transformed layout 18 including another image 20*a*. As the game 10 proceeds, the player can select a certain number of cells via the game application 27 from the entire group of cells 16 within the transformed layout 18, and the indicia 20, 22 within the selected cells 16 is revealed to the player by the game application 27 by executing the instructions for generating the original image for the winning 20 or non-winning 22 indicia included in the plural cells 16 within the layout 18. The game application further transforms the selected cells 16 in the layout 18 from displaying another image 20*a*, 22*d* to displaying an image for a winning indicia 20 or a non-winning indicia 22 in the selected cells 16 by executing the instructions stored in the selected cells for displaying the image stored therein.

If, after revealing the selected cells 16, a certain number and/or combination of winning indicia 20 have been selected and revealed, the player wins the game 10. Depending upon the specific number and/or combination of winning indicia 20 exposed by the player, a prize is determined for a winning game 10.

Figure 2:
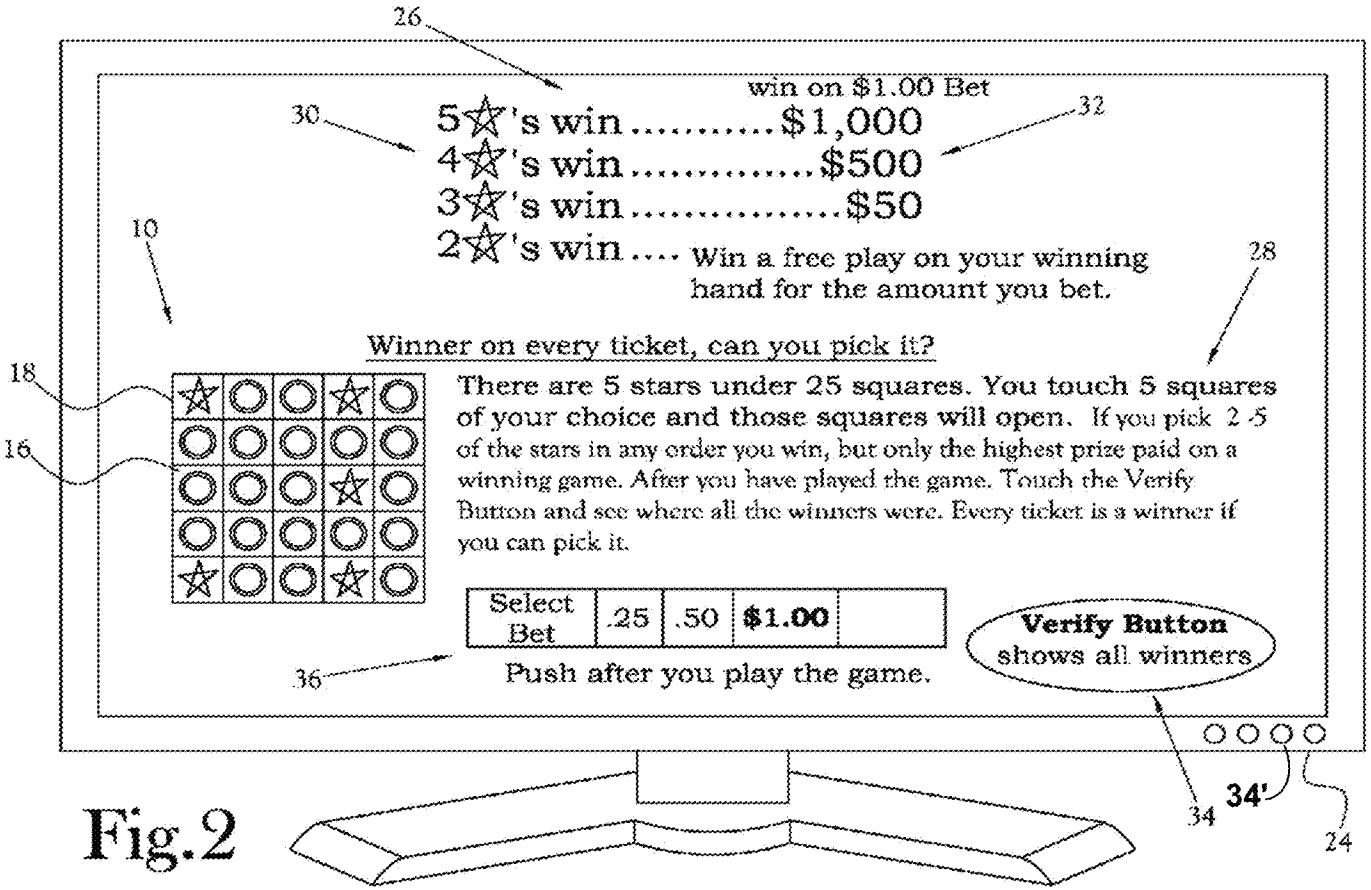
FIG. 2 is a depiction of a graphical user interface showing one embodiment of a game of chance constructed in accordance with several features of the present general inventive concept.

For example, in FIGS. 1 and 2, each of the indicia 20, 22 within each of the cells 16 in the layout 18 is initially concealed from the player by the game application 27 automatically displaying the plural cells 16 of the transformed layout 18 including another image 20*a*, 22*d*. As the game 10 proceeds, the player is given the opportunity to select a pre-determined number of cells 16 (e.g., five, etc.) for which the indicia 20, 22 included therein is revealed to the player. The object of the game 10 is for the player to maximize the number of cells 16 included winning indicia 20 that are selected and revealed by the player and minimize the number of cells 16 including non-winning indicia 22. In various embodiments, in the event the player selects a threshold pre-determined number of cells 16 containing winning indicia 20, the player wins the game 10.

Referring to FIG. 2, in a preferred embodiment, the game 10 is implemented through the use of a network device 13, 15, 17, that is in communication with a display component including a graphic interface 24 and/or other type of display component. The graphic interface 24 is configured by the game application 27 to display an image of the layout 18 and to cooperate with the game application 27 and the network device 13, 15, 17 to allow a player to select individual cells 16, and make other commands within the displayed layout 18, for example to initiate a game, set forth an initial wager, select cells 16 to reveal, and collect prize awards.

It will be understood that any of a variety of network devices 13, 15, 17 and associated display devices, for example a personal computer with a video monitor display 24, a video arcade machine, a portable communication device having a touch-screen video display or other touch screen device, an electronic game board, etc., may be implemented using sound engineering judgment to produce an image of the layout 18 of the game 10 and to allow a user to interface with the game 10 as discussed above.

As shown in FIG. 2, in one embodiment of the invention, the graphic interface 24 for the network device 13, 15, 17 is provided which includes plural of video and/or graphical representations of various aspects of the game 10. For example, in the illustrated embodiment, an image of the layout 18 of the game 10 is provided, along with an instructional display 26 showing textual instructions 28 for how to play the game 10, the various possible winning combinations of indicia 30, and the available prizes 32 for each winning combination.

The graphic interface 24 further displays plural graphical controls to allow a user to interact with the game 10 via the game application 27. For example, a first series of graphical controls are provided by the game application 27 to allow a player to select which cells 16 the player wishes to reveal. In the illustrated embodiment, these graphical controls are overlaid within and/or on the various cells 16 of the layout 18, as by employing a touch-screen graphic interface 24 or other such device or interface, such that a player may select which cells 16 to reveal by directly engaging the cells themselves (e.g., touching a specific location on the graphic interface including a desired cell, etc.)

In another embodiment (not shown), a separate series of graphical buttons are provided by the game application 27, and/or mechanical buttons provided on the network device 13, 15, 17 in communication with the game application 27 to allow a user to designate particular cells 16 within the layout 18 to be revealed without touching an individual cell 16 within the layout 18.

A wager control 36 is also provided by the game application 27 (e.g., via a separate graphical button and/or mechanical button, etc.) to allow the player to select and place an initial wager, at a beginning of a new game 10. In the illustrated embodiment, the wager control 36 is configured via the game application 27 to allow a player to select an initial wager of $0.25, $0.50, $1.00, or $5.00 per game 10. However, the present invention is not limited to the wager amounts described and more, fewer and/or other wager amounts can be used to practice the invention.

In the illustrated embodiment of FIG. 2, a verify game control 34 is also provided by the game application 27. Upon a player accessing the verify game control 34, the game 10 is terminated, and all winning indicia 20 and non-winning indicia 22 are revealed by the game application 27 on the display component 24, thereby allowing the player to see the location of all winning indicia 20 and non-winning indicia 22 in the cells 16 in the layout 18.

In one embodiment, the verify game control 34 further serves to terminate a winning game 10, such that once a player reveals the allotted number cells 16 with winning indicia 22.

In one embodiment, the verify game control 34 further serves to terminate a game 10, such that once a play selects the verify game control 34 no matter how many winning 20 and/or non-winning 22 indicia have been revealed by the player.

In one embodiment, the verify game control 34 is also engaged to initiate a determination and/or awarding of prizes 32 by the game 10.

In other embodiment, the game 10 terminates automatically upon selection of the allotted number of cells 16 to be revealed by the player.

In one embodiment, the game application 27 implementing the game 10 is configured such that a player may not reveal a number of cells 16 greater than the number of cells containing winning indicia 20.

For example, in one embodiment in which the above-discussed twenty-five cells 16 including five winning indicia 20 and twenty non-winning indicia 22 are used, game application 27 is configured such that, upon revealing five cells 16, the verify game control 34 is automatically engaged, such that the game 10 is terminated, and the results of the game 10 are determined. Thus, it will be recognized that implementation of the game 10 using with the game application 27 with the verify game control 34 provides the advantage of limiting intentional tampering of the game 10, such that a player or third party is prevented from voiding the game 10 by revealing additional cells 16 beyond the number of cells 16 allowed to be revealed by the player during normal game 10 play.

It will be also recognized that the above-described game 10 provides a unique advantage of allowing a player to participate in the outcome selection of the game 10, while also assuring the player that a winning outcome is possible for each iteration of the game 10, thereby reducing and/or eliminating suspicion and/or actual occurrences of fraud, tampering and/or unfair play.

For example, in the above-described embodiment illustrated in FIG. 1 with layout of five rows 12 and five columns 14, a player is assured from the beginning of the game 10 that each particular layout 18 contains exactly five winning indicia 20 and twenty non-winning indicia 22 throughout the grid of cells 16 in the layout. Thus, the only factors in determining the outcome of the game 10 are the particular distribution of winning indicia 20 throughout the cells 16 of the layout 18 by the game application 27 and the particular choices of the player in selecting which cells 16 in the transformed layout 18 displayed by the game application to reveal. Because the decisions of the player, rather than the actions of the organizer of the game 10, ultimately determine the outcome of the game 10, the player is therefore assured that the game 10 is being played fairly, and is not subjected to manipulation or fraud by the game's organizer.

In one embodiment, the game 10 includes a wager control 36. For example, in order to initiate a game 10, a player must set forth an initial wager. In the illustrated embodiment of FIG. 1, the initial wager may be an amount of currency, such as for example $1.00, which must be paid to an organizer of the game 10 to allow the player to participate. Thereafter, in the event the player fails to select a sufficient number of cells 16 containing winning indicia 20, such that the player does not win the game 10, the wager amount is forfeited to the organizer. However, if the player selects a sufficient number of cells 16 containing winning indicia 20, such that the player wins the game 10, the player receives a prize, such as for example another amount of currency or other prize. In certain embodiments, the prize is valued greater than the initial wager. However, the prize may also be valued less than the initial wager, or may have no intrinsic monetary value, without departing from the spirit and scope of the present general inventive concept.

In certain embodiments, the game 10 includes a feature by which the prize grows depending upon the number and/or combination of cells 16 containing winning indicia 20 selected by the player. For example, in the embodiment of FIG. 1, the value of the prize awarded to the player varies depending upon the number of winning indicia 20 revealed by the player during the player's selection of cells. The values of the varying prizes are selected, at least in part, based on the probability that the player selects and reveals the particular cells necessary to produce the particular outcome of the game 10. In the illustrated embodiment in FIG. 1, in the event the selection of five cells by the player reveals two winning indicia 20, the player receives an amount equal to the amount of the player's initial wager. In the event the selection of five cells by the player reveals three winning indicia 20, the player receives an amount equal to fifty-times the player's initial wager, which equals $50.00 for a $1.00 initial wager. In the event the selection of five cells by the player reveals four winning indicia 20, the player receives an amount equal to one-hundred-times the player's initial wager, which equals $500.00 for a $1.00 initial wager. In the event the selection of five cells by the player reveals five winning indicia 20, the player receives an amount equal to one-thousand-times the player's initial wager, which equals $1,000.00 for a $1.00 initial wager. In the event the selection of five cells by the player reveals one or zero winning indicia 20, the initial wager is forfeited by the player.

While the above-referenced embodiments have been described using an exemplary layout 18 including a grid of twenty five cells 16 having five winning indicia 20 and twenty non-winning indicia 22, it will be recognized that other designs and numbers and displays of indicia may be used to accomplish the layout 18 without departing from the spirit and scope of the present general inventive concept. In another embodiment, the layout may include greater or fewer cells. For example, in one embodiment, a layout is provided having thirty-six cells 16 with six winning indicia 20 and thirty non-winning indicia 22. In this embodiment, a player may select up to six cells 16 to reveal the indicia therein 20, 22. Prizes 32 of varying value are provided for each outcome in which a player selects and reveals two or more winning indicia 20, with the values of the prizes 32 for the varying outcomes being selected, at least in part, based on the statistical probability of the player selecting the cells 16 necessary to produce a particular outcome.

In other embodiments, rather than providing a layout 18 in which certain cells contain winning indicia 20 and other cells contain non-winning indicia 22, a layout is provided by the game application 16 in which a variety of indicia 20, 22 are provided among the cells, and whether, and the degree to which, a player wins the game 10 depends upon the specific combination of different types of indicia revealed by the player.

Figure 3:
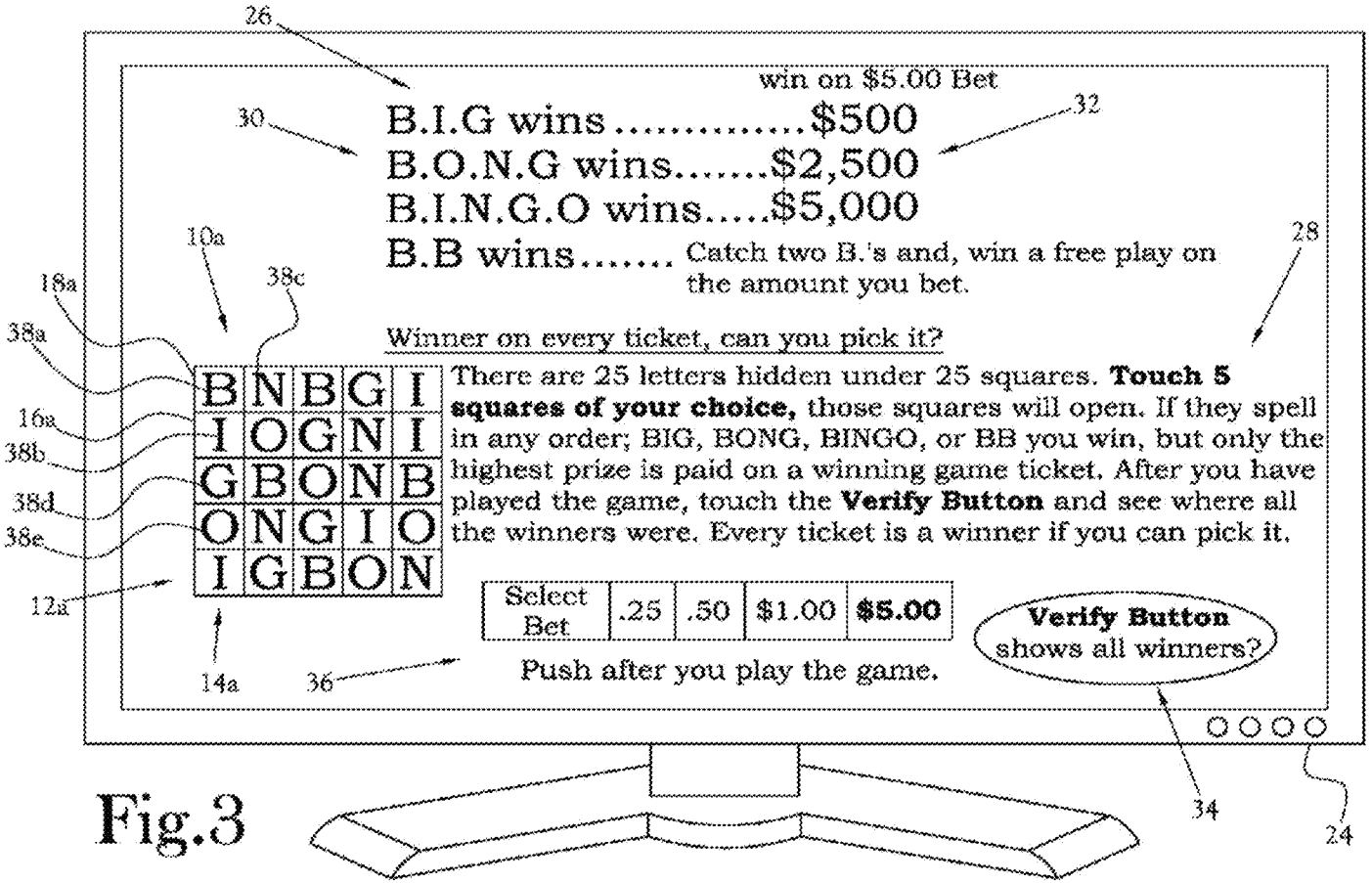
FIG. 3 is a depiction of a graphical user interface showing another embodiment of a game of chance constructed in accordance with several features of the present general inventive concept.

For example, FIG. 3 illustrates an alternate embodiment of the game 10*a* in which a layout 18*a* is provided having twenty-five cells 16*a* arranged into a grid of five rows 12*a* and five columns 14*a*. Each cell 16*a* contains one of five different indicia 38*a*-38*e*. In the illustrated embodiment, a first indicia 38*a* is defined by the letter "B," a second indicia 38*b* is defined by the letter "I," a third indicia 38*c* is defined by the letter "N," a fourth indicia 38*d* is defined by the letter "G," and a fifth indicia 38*e* is defined by the letter "0." In this embodiment, the player is permitted to select and reveal the indicia in five of the cells, reveal a particular combination of indicia sufficient to allow the formation of one or more particular words from the revealed indicia. For example, in the event the selection of five cells by the player reveals two of the first indicia 38*a*, such that the word "B.B." can be formed, the player is awarded a free play based on the initial wager amount, in other words, to repeat the game 10. In the event the selection of five cells by the player reveals one of the first indicia 38*a*, one of the second indicia 38*b*, and one of the fourth indicia 38*d*, such that the word "BIG" can be formed, the player receives an amount equal to fifty-times the player's initial wager. In the event the selection of five cells by the player reveals one of the first indicia 38*a*, one of the fifth indicia 38*e*, one of the third indicia 38*c*, and one of the fourth indicia 38*d*, such that the word "BONG" can be formed, the player receives an amount equal to five-hundred-times the player's initial wager. In the event the selection of five cells by the player reveals one of the first indicia 38*a*, one of the second indicia 38*b*, one of the third indicia 38*c*, one of the fourth indicia 38*d*, and one of the fifth indicia 38*e*, such that the word "BINGO" can be formed, the player receives an amount equal to one-thousand-times the player's initial wager. In the event the selection of five cells by the player reveals a combination of the various indicia through which none of the above-discussed words may be formed, the initial wager is forfeited by the player. However, the present invention is not limited to such embodiments and other embodiments can be used to practice the invention.

In another embodiment, the player is able to choose a symbolic designation for each of the five different indicia 38*a*-38*e* at the outset of the game 10. For example, in one embodiment, at the outset of the game 10, a player is presented with an option to choose symbols corresponding to the various indicia 38*a*-38*e*. The player may choose, for example, for the first indicia 38*a* to be a particular number, the second indicia 38*b* to be a particular letter, the third indicia 38*c* to be a particular symbol, and so forth. It will be understood that the player may choose for each of the indicia 38*a*-38*e* to be any of a number, a letter, a symbol, or the like. Furthermore, the player may choose, in certain embodiments, for the each of the indicia 38*a*-38*e* to be selected by a third party, such as for example the game organizer. Once the various indicia 38*a*-38*e* are selected, the various cells 16 are each designated with a particular selected indicia 38*a*-38*e*, and the game 10 proceeds as discussed above. It will be understood that the above-described selection by the player of symbolic designations for each of the five different indicia 38*a*-38*e* at the outset of the game 10 is not necessary to accomplish the present general inventive concept.

Figure 4:
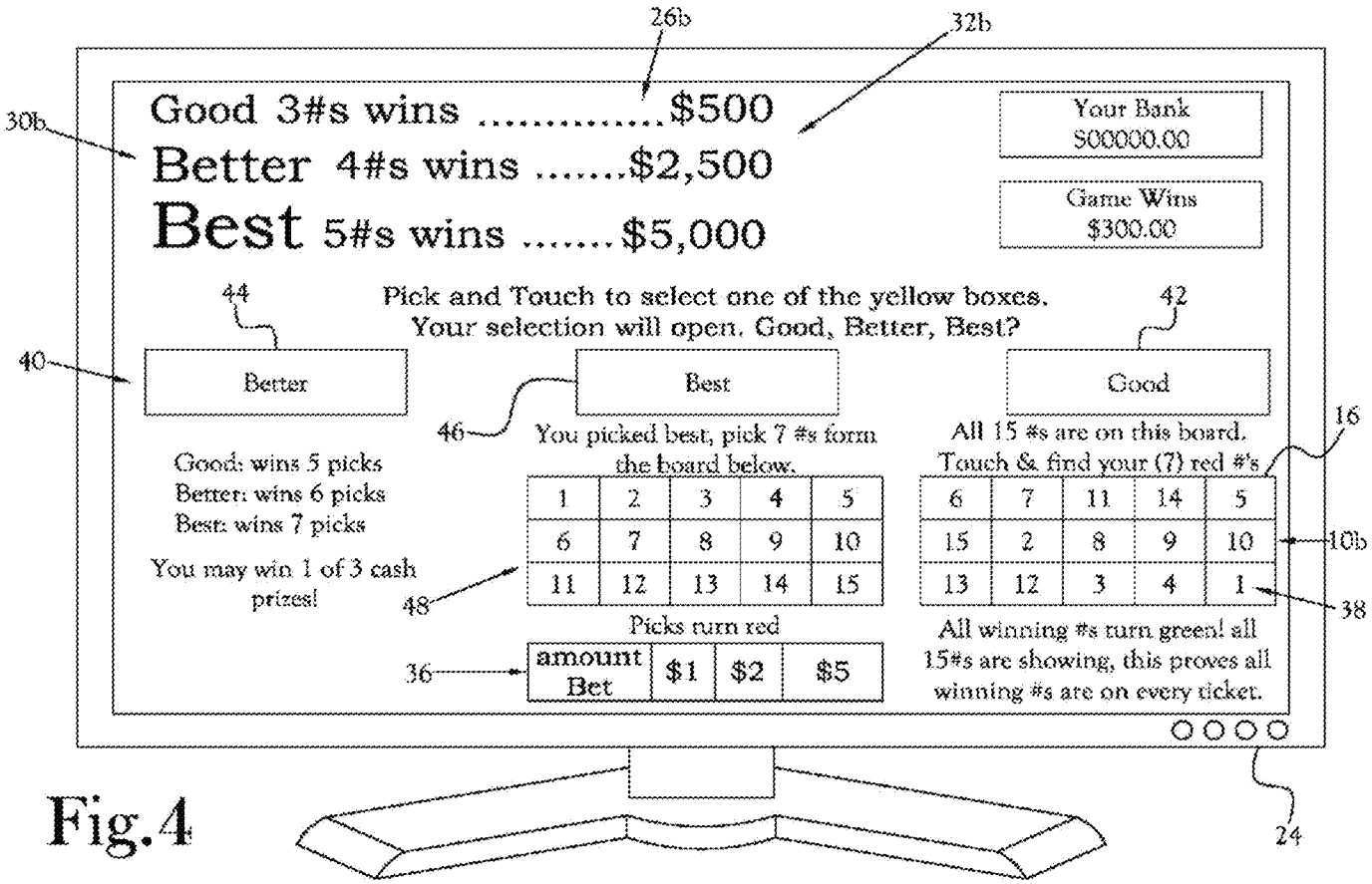
FIG. 4 is a depiction of a graphical user interface showing another embodiment of a game of chance constructed in accordance with several features of the present general inventive concept.

FIG. 4 illustrates another embodiment of the game 10*b*, displayed on a graphical user interface 26 as discussed above. In the embodiment of FIG. 4, each cell 16 of the game 10*b* contains a different indicia 38, such as for example sequential numbers, letters, etc. At the onset of the game 10*b*, an initial option 40 is presented to the player to allow the player to choose the number of indicia 38 in the game 10*b* to be designated as winning indicia. For example, in the illustrated embodiment, fifteen total cells 16 are provided, with sequential numerical indicia 38, numbers 1-15, included in the cells 16. At the onset of the game 10*b* the player is presented with the initial option 40 in the form of three game controls, labeled "Good" 42, "Better" 44, and "Best" 46, respectively. In the event a player activates the "Good" control 42, the player is then able to access additional controls 48 to select five of the fifteen indicia 38 to be designated as winning indicia. In the event a player activates the "Better" control 44, the player is then able to access the additional controls 48 to select six of the fifteen indicia 38 to be designated as winning indicia. In the event a player activates the "Best" control 46, the player is then able to access the additional controls 48 to select seven of the fifteen indicia 38 to be designated as winning indicia. Once the winning indicia are selected, the player is then able to access the game layout 10*b* to select cells 16 for which to reveal the indicia 38 included therein, with the object of the game being to maximize the number of winning indicia revealed.

Referring to the instructional display 26*b* of FIG. 4, in the illustrated embodiment, the various possible winning combinations of indicia 30*b*, and the available prizes 32*b* for each winning combination depend, at least in part, upon the number of winning indicia in the game 10*b*. For example, in the illustrated embodiment, if the player selects a wager amount 36 of $5.00, and if the "Good" game control 42 is selected, thereby invoking five winning indicia into the game a player must reveal at least three winning indicia through game play in order to win, with the available prize 32*b* for a winning game being $500.00. For the same selected wager amount, if the "Better" game control 44 is selected, thereby invoking six winning indicia into the game 10*b*, a player must reveal at least four winning indicia through game play in order to win, with the available prize 32*b* for a winning game being $2,500.00. For the same selected wager amount, if the "Best" game control 46 is selected, thereby invoking seven winning indicia into the game 10*b*, a player must reveal at least five winning indicia through game play in order to win, with the available prize 32*b* for a winning game being $5,000.00.

Figure 5:
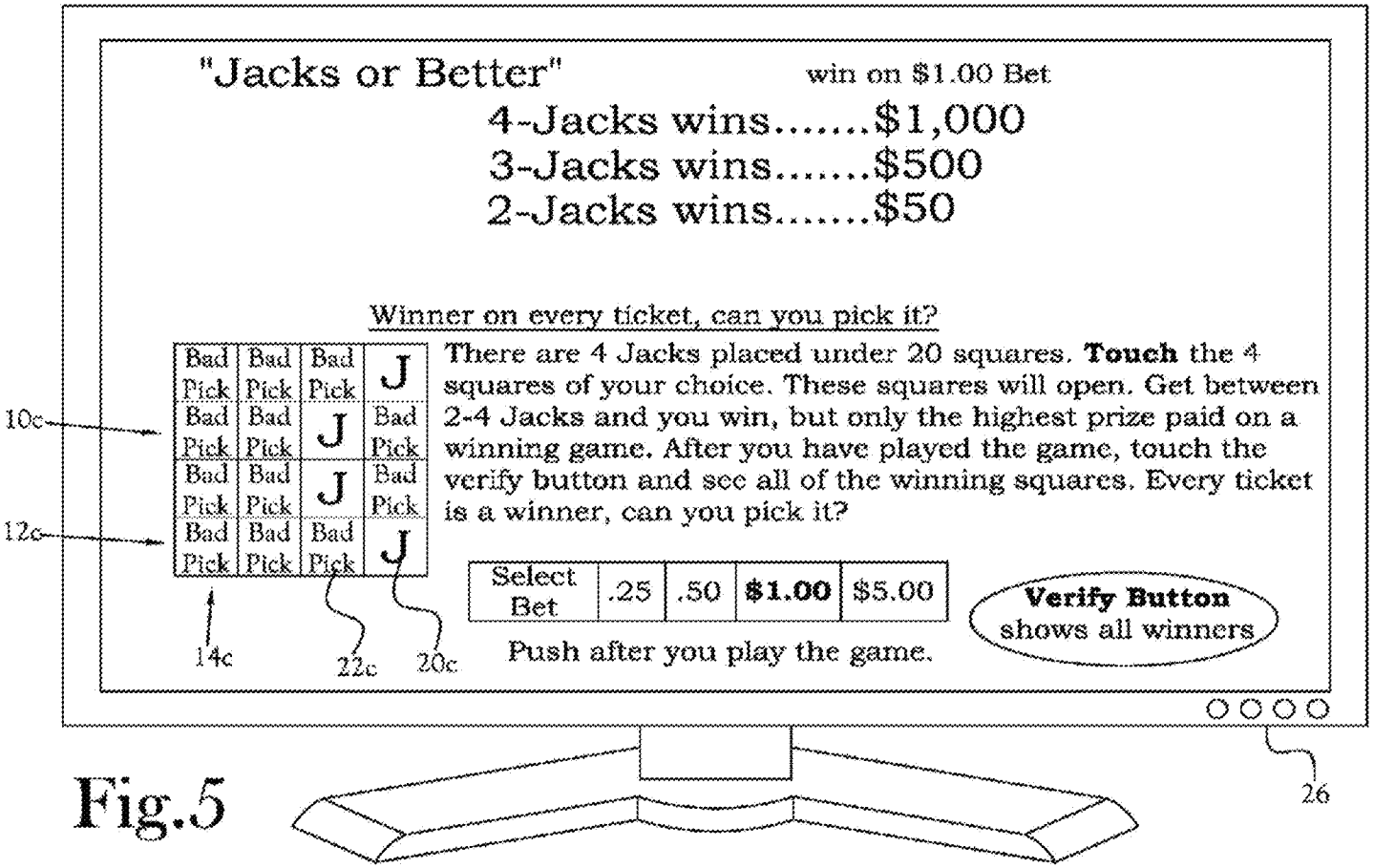
FIG. 5 is a depiction of a graphical user interface showing another embodiment of a game of chance constructed in accordance with several features of the present general inventive concept.

FIG. 5 illustrates another embodiment of the game displayed on a graphical user interface 24 as discussed above. In the embodiment of FIG. 5, sixteen cells 16 are provided, arranged into a grid of four rows 12*c* and four columns 14*c*. Four winning indicia 20*c* are provided, illustrated by a letter "J," and twelve non-winning indicia 22*c* are provided, with one indicia 20*c*, 22*c* provided in each cell 16. In the illustrated embodiment, the player is given the opportunity to reveal four cells 16, and prizes are awarded for revealing at least two winning indicia 20*c*. For example, in the illustrated embodiment, for a selected wager of $1.00, the prize awarded for revealing two winning indicia 20*c* is $50.00, the prize awarded for revealing three winning indicia 20*c* is $500.00, and the prize awarded for revealing four winning indicia 20*c* is $1,000.00.

FIG. 6 illustrates another embodiment of the game displayed on a graphical user interface 24 as discussed above. In the embodiment of FIG. 6, twelve cells 16 are provided, with three winning indicia 20*d* and nine non-winning indicia 22*d* provided among the cells 16. In this embodiment, during game play, the player may reveal the contents of three cells 16. In the event the player reveals only one winning indicia 20*d*, a prize of $1.00 is awarded. In the event the player reveals only two winning indicia 20*d*, a prize of $125.00 is awarded. In the event the player reveals three winning indicia 20*d*, a prize of $250.00 is awarded.

FIG. 7 illustrates another embodiment of the game displayed on a graphical user interface 24 as discussed above. In the embodiment of FIG. 7, twenty-five total cells 16 are provided, with sequential numerical indicia 38, numbers 1-25, included in the cells 16. At the onset of the game 10*e*, the player is able to access controls 48*e* to select five of the twenty-five indicia 38 to be designated as winning indicia. Once the winning indicia are selected, the player is then able to access the game layout 10*e* to select cells 16 for which to reveal the indicia 38 included therein, with the object of the game being to maximize the number of winning indicia revealed. In the illustrated embodiment, if the player selects a wager amount 36 of $5.00, and three winning indicia are revealed, the available prize 32*e* is $250.00. For the same selected wager amount, if four winning indicia are revealed, the available prize 32*e* is $2,500.00. For the same selected wager amount, if five winning indicia are revealed, the available prize 32*e* is $5,000.00.

Figure 8A:
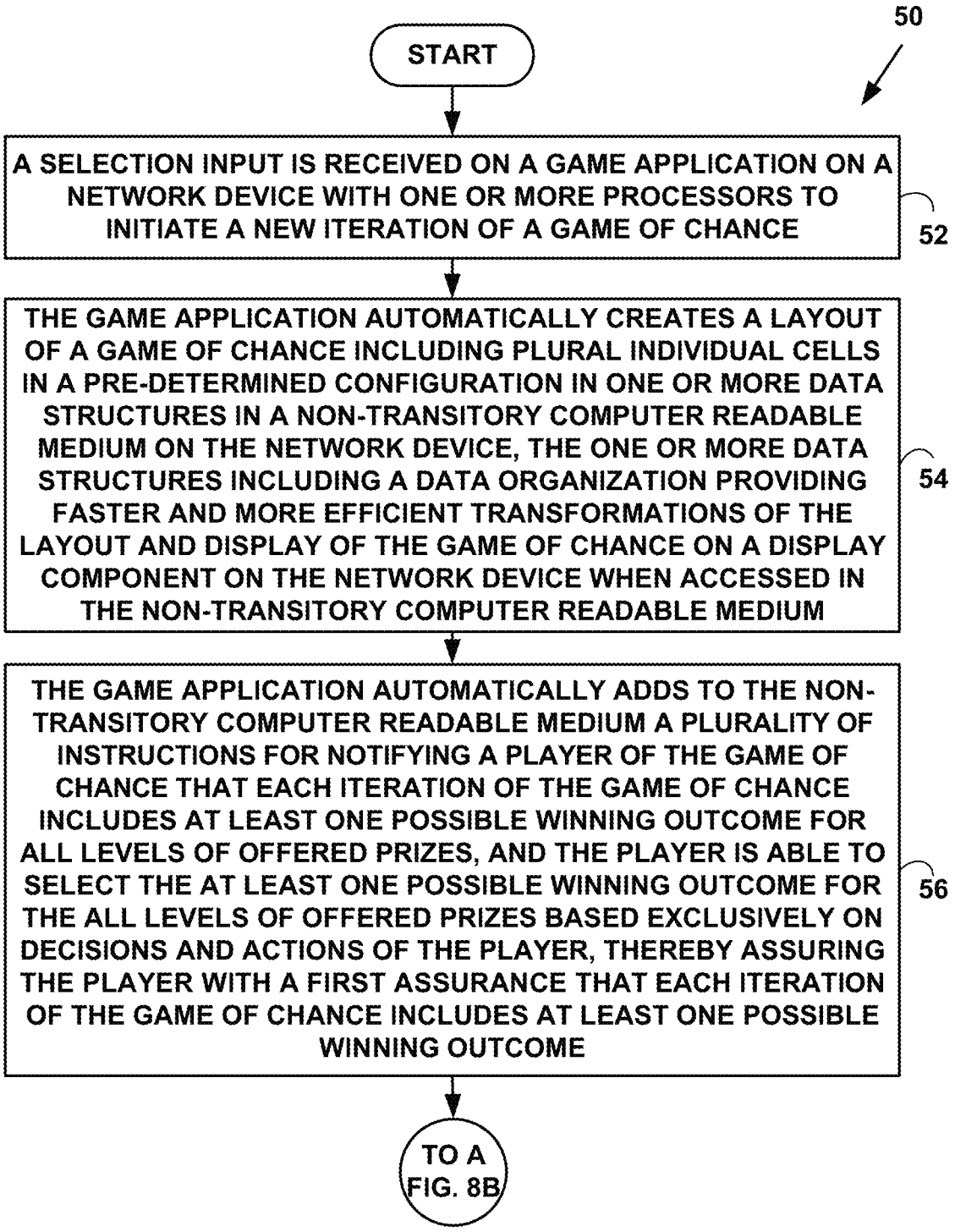
Figure 8B:
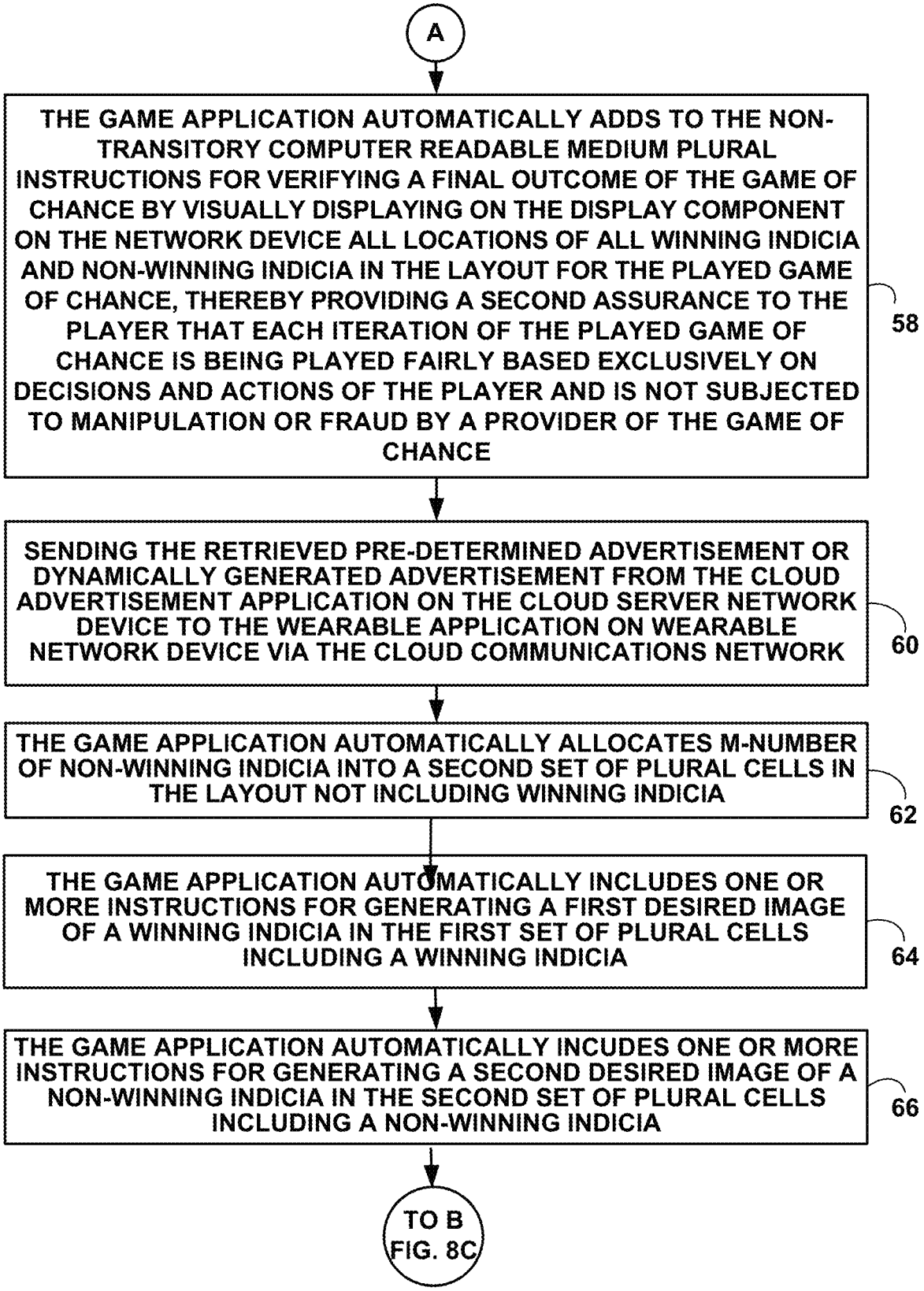
Figure 8C:
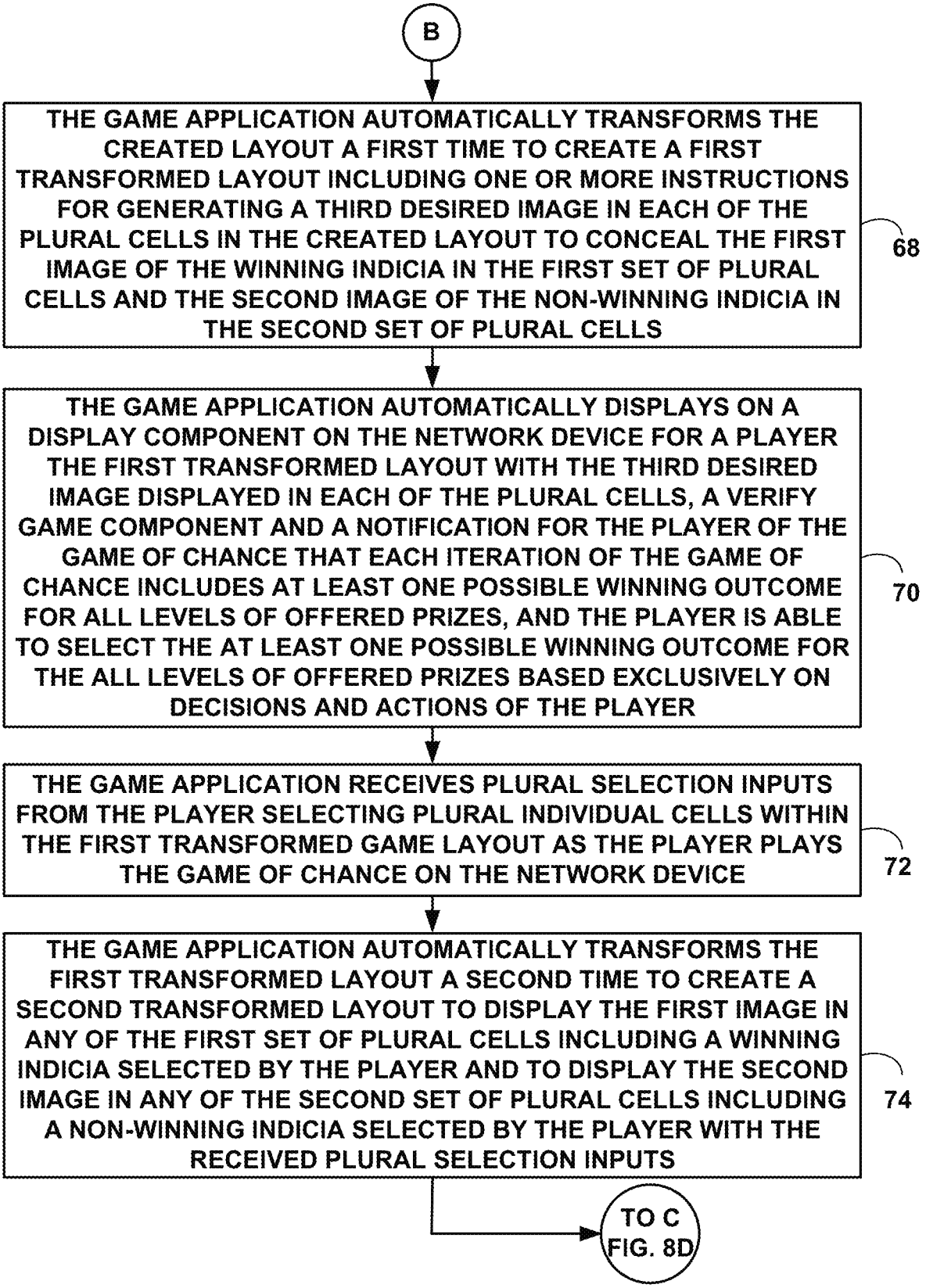
Figure 8D:
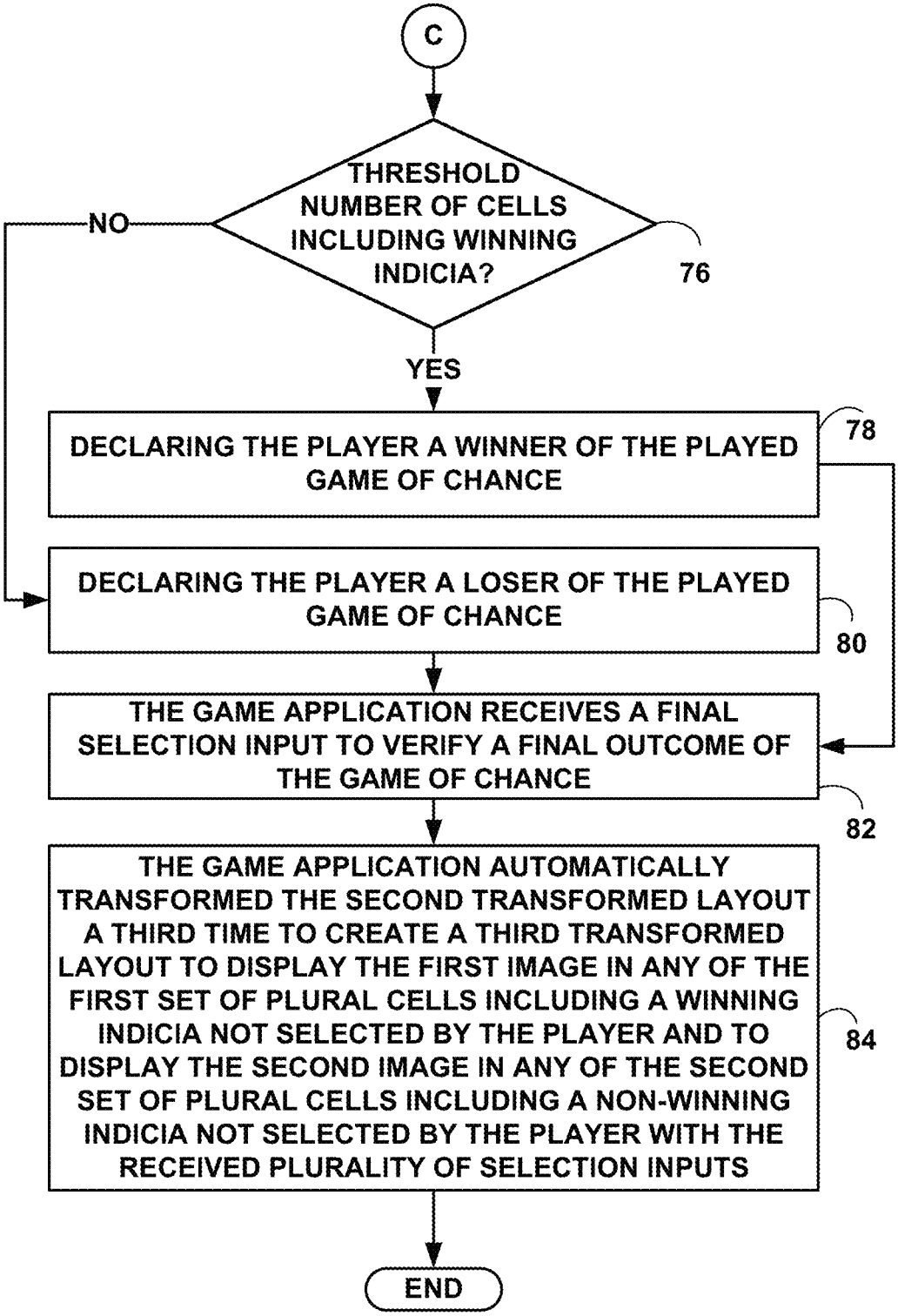

FIGS. 8A, 8B, 8C and 8D are a flow diagram illustrating a Method 50 for playing a game of chance. In FIG. 8A at Step 52, a selection input is received on a game application on a network device with one or more processors to initiate a new iteration of a game of chance. At Step 54, the game application automatically creates a layout of a game of chance including plural individual cells in a pre-determined configuration in one or more data structures in a non-transitory computer readable medium on the network device. The one or more data structures including a data organization providing faster and more efficient transformations of the layout and display of the game of chance on a display component on the network device when accessed in the non-transitory computer readable medium. At Step 56, the game application automatically adds to the non-transitory computer readable medium plural instructions for notifying a player of the game of chance that each iteration of the game of chance includes at least one possible winning outcome for all levels of offered prizes, and the player is able to select the at least one possible winning outcome for the all levels of offered prizes based exclusively on decisions and actions of the player, thereby assuring the player with a first assurance that each iteration of the game of chance includes at least one possible winning outcome. In FIG. 8B at Step 58, the game application automatically adds to the non-transitory computer readable medium plural instructions for verifying a final outcome of the game of chance by visually displaying on the display component on the network device all locations of all winning indicia and non-winning indicia in the layout for the played game of chance, thereby providing a second assurance to the player that each iteration of the played game of chance is being played fairly based exclusively on decisions and actions of the player and is not subjected to manipulation or fraud by a provider of the game of chance. At Step 60, the game application automatically and randomly allocates N-number of winning indicia into a first set of plural cells in the layout, wherein the N-number of winning indicia is a pre-determined percentage of non-winning number of indicia and wherein the winning indicia included therein providing the at least one possible winning outcome selectable by the player for every iteration of the game of chance. At Step 62, the game application automatically allocates M-number of non-winning indicia into a second set of plural cells in the layout not including winning indicia. At Step 64, the game application automatically includes one or more instructions for generating a first desired image of a winning indicia in the first set of cells including a winning indicia. At Step 66, the game application automatically includes one or more instructions for generating a second desired image of a non-winning indicia in the second set of cells including a non-winning indicia. In FIG. 8C at Step 68, the game application automatically transforms the created layout a first time to create a first transformed layout including one or more instructions for generating a third desired image in each of the plural cells in the created layout to conceal the first image of the winning indicia in the first set of plural cells and the second image of the non-winning indicia in the second set of plural cells. At Step 70, the game application automatically displays on a display component on the network device for a player the first transformed layout with the third desired image displayed in each of the plural cells, a verify game component and a notification for the player of the game of chance that each iteration of the game of chance includes at least one possible winning outcome for all levels of offered prizes, and the player is able to select the at least one possible winning outcome for the all levels of offered prizes based exclusively on decisions and actions of the player. At Step 72, the game application receives plural selection inputs from the player selecting plural individual cells within the first transformed game layout as the player plays the game of chance on the network device. At Step 74, the game application automatically transforms the first transformed layout a second time to create a second transformed layout to display the first image in any of the first set of plural cells including a winning indicia selected by the player and to display the second image in any of the second set of plural cells including a non-winning indicia selected by the player with the received plural selection inputs. In FIG. 8D at Step 76, the game application determines whether the player has selected and revealed a threshold number of cells including winning indicia, and if so, at Step 78, declaring the player a winner of the played game of chance and if not at Step 80, declaring the player a loser of the played game of chance. At Step 82, the game application receives a final selection input to verify a final outcome of the game of chance. At Step 84, the game application automatically transformed the second transformed layout a third time to create a third transformed layout to display the first image in any of the first set of plural cells including a winning indicia not selected by the player and to display the second image in any of the second set of plural cells including a non-winning indicia not selected by the player with the received plurality of selection inputs.

Method 50 is illustrated with an exemplary embodiment. However, the present invention is not limited to this exemplary embodiment and other embodiments can be used to practice the invention.

In FIG. 8A at Step 52, a selection input is received on a game application 27 on a network device 13, 15, 17 with one or more processors to initiate a new iteration of a game of chance 10.

At Step 54, the game application 27 automatically creates a layout 18 of a game of chance 10 including plural individual cells 16 in a pre-determined configuration in one or more data structures 29 in a non-transitory computer readable medium on the network device 13, 15, 17. The one or more data structures 29 including a data organization providing faster and more efficient transformations of the layout 18 and display of the game of chance 10 on a display component 24 on and/or associated with the network device 13, 15, 17 when accessed in the non-transitory computer readable medium.

In one embodiment, the data structure 29 includes a different data organization for the layout 18 than is used to display the layout 18. For example, the layout 18 may be displayed as a 5×5 display of five rows and five columns where the data structure is not a 5×5 matrix but instead is two linked lists or two queues, a first with plural winning indicia 20 and a second with plural non-winning indicia 22 an/or one or more dynamic binary trees, hash tables, graphs etc. that include only winning indicia 20 and/or both winning and non-winning indicia 20, 22. Such a data organization in the data structure 29 provides faster and more efficient transformations of the layout 18 and faster and more efficient displaying of the plurality of individual cells 16 for playing of the game 10 for the player. The linked list and queue data structures 29 are exemplary only and the invention is not limited to linked list data structures and other data organizations and data structures includes, trees, graphs, hash tables, can be used to practice the invention.

In one embodiment the data structure 29 includes a dynamic binary tree that is dynamically adjusted each time a player selects a cell 16. In one exemplary embodiment, the dynamic binary tree stores only winning indicia 20 that have been selected. In another embodiment, the dynamic binary tree stores all indicia 20, 22 and is adjusted dynamically for fast and optimal display of the indicia 20, 22 in a graphical display of the layout 18.

In another embodiment the data structure 29 includes a hash table. A hash table (hash map) is a data structure 29 which implements an associative array abstract data type, a structure that can map keys to values. A hash table uses a hash function to compute an index into an array of buckets or slots, from which the desired value can be found. For example, a hash table is set up to include links to only winning indicia 20 and/or both winning and non-winning indicia 20, 22 stored in the non-transitory computer readable medium.

In another embodiment, the data structure 29 includes a graph. A graph is set of items connected by edges. Each item is called a vertex or node. Formally, a graph is a set of vertices and a binary relation between vertices, adjacency. For example, a graph is set up to include only winning indicia 20 at selected vertexes or nodes and connected to other winning indicia 20 vertexes or nodes with edges and/or both winning and non-winning indicia 20, 22 stored at the vertexes or nodes.

In these embodiments, (e.g., dynamic, binary tree, hash table, graph, etc.) the data structure 29 is organized in a way to quickly and efficiently retrieve data from the data structure 29 and use it on a display component 24 to display original images and/or concealed images for the plural cells 16 on the layout 18.

However, the present invention is not limited to any of the data structures described and more, fewer, combinations thereof and/or other data structures can be used to practice the invention.

In another embodiment, the data structure 29 includes a same data organization as is used for the layout 18 and also provides faster and more efficient transformations of the layout 18 and faster and more efficient displaying of the game 10 for a player. For example, a layout 18 comprising a 5×5 matrix of rows and columns, the data structure includes a two-dimensional data structure array with five rows and five columns (e.g., data_layout[5][5], etc.). The data structures 29 described are exemplary only and the invention is not limited to the data structures described and other data organizations can be used to practice the invention.

In one embodiment, the pre-determined configuration includes a two-dimensional matrix of X-rows and Y-columns, wherein the values of X and Y are positive integer numbers or a three-dimensional matrix of X-rows, Y-columns and Z-pages, wherein the values of X, Y and Z are positive integer numbers. Positive integer numbers do not include the value zero. However, the present invention is not limited to these embodiments and other pre-determined configurations can also be used to practice the invention.

In one embodiment, the layout 18 for the game of chance is received on the game application 27 on a communications interface from a second network device via a communications network 19. In one embodiment, the second network device includes a server network device 21, 23, 25 with one or more processors.

At Step 56, the game application 27 automatically adds to the non-transitory computer readable medium plural instructions for notifying a player of the game of chance 10 that each iteration of the game of chance 10 includes at least one possible winning outcome for all levels of offered prizes, and the player is able to select the at least one possible winning outcome for the all levels of offered prizes based exclusively on decisions and actions of the player, thereby assuring the player with a first assurance that each iteration of the game of chance 10 includes at least one possible winning outcome.

In FIG. 8B at Step 58, the game application 27 automatically adds to the non-transitory computer readable medium plural instructions for verifying 34 a final outcome of the game of chance by visually displaying on the display component 24 on the network device 13, 15, 17 all locations of all winning indicia 20 and non-winning indicia 20 in the layout 18 for the played game of chance 10, thereby providing a first assurance to the player that each iteration of the played game of chance 10 is being played fairly based exclusively on decisions and actions of the player and is not subjected to manipulation or fraud by a provider of the game of chance 10.

At Step 60, the game application 10 automatically and randomly allocates N-number of winning indicia 20 into a first set of plural cells 16 in the layout 19, wherein the N-number of winning indicia 20 is a pre-determined percentage of non-winning number of indicia 22 and wherein the winning indicia 20 included therein providing the at least one possible winning outcome selectable by the player for every iteration of the game of chance 10.

In one embodiment, the N-number of winning indicia 22 comprise individual letters for a pre-determined word in a pre-determined language. In one embodiment, the pre-determined word includes the word, BINGO, in the English language.

In one embodiment, the N-number of winning indicia 22 comprise a sequence of numbers and individual letters in a pre-determined language.

In one embodiment, the N-number of winning indicia 22 comprise a pre-determined sequence and/or pattern of numbers.

In one embodiment, the N-number of winning indicia 22 comprise a pre-determined set of graphical symbols or graphical images, a pre-determined set of digital images and/or a pre-determined set of video images.

However, the present invention is not limited to these embodiments and other embodiments for the N-number of winning indicia 20 can also be used to practice the invention.

At Step 62, the game application 27 automatically allocates M-number of non-winning indicia 22 into a second set of plural cells in the layout 18 not including winning indicia 20.

At Step 64, the game application 27 automatically includes one or more instructions for generating a first desired image (e.g., a star, etc.) of a winning indicia 20 in the first set of cells including a winning indicia 20.

At Step 66, the game application 27 automatically includes one or more instructions for generating a second desired image (e.g., circle, etc.) of a non-winning indicia 22 in the second set of cells including a non-winning indicia 22.

In FIG. 8C a Step 68, the game application 27 automatically transforms the created layout 18 a first time to create a first transformed layout 18' including one or more instructions for generating a third desired image 33 (FIG. 1, including the text "PICK A STAR", etc.) in each of the plural cells 16 in the created layout 18 to conceal the first image of the winning indicia 20 in the first set of plural cells and the second image of the non-winning indicia 22 in the second set of plural cells.

At Step 70, the game application automatically displays on a display component on the network device for a player the first transformed layout with the third desired image displayed in each of the plurality of cells, a verify game component 34 and a notification for the player of the game of chance that each iteration of the game of chance includes at least one possible winning outcome for all levels of offered prizes, and the player is able to select the at least one possible winning outcome for the all levels of offered prizes based exclusively on decisions and actions of the player.

At Step 72, the game application 27 receives plural selection inputs from the player selecting plural individual cells 16 within the first transformed game layout 18 as the player plays the game of chance 10 on the network device 13, 15, 17.

At Step 74, the game application 27 automatically transforms the first transformed layout 18' a second time to create a second transformed layout 18" to display the first image in any of the first set of plural cells 16 including a winning indicia 20 selected by the player and to display the second image in any of the second set of plural cells 16 including a non-winning indicia 22 selected by the player with the received plural selection inputs.

In FIG. 8D at Step 76, the game application 27 determines whether the player has selected and revealed a threshold number of cells 16 including winning indicia 22, and if so, at Step 78, declaring the player a winner of the played game of chance 10, and if not at Step 80, declaring the player a loser of the played game of chance 10.

At Step 82, the game application 28 receives a final selection input to verify a final outcome of the game of chance 10.

In one embodiment, Step 82 includes receiving the selection input from a verify game graphical button 34 displayed on the display component 24 of the network device 13, 15, 17 and/or from a mechanical button 34' (e.g., FIG. 2, etc.) on the network device 13, 15, 17.

At Step 84, the game application 27 automatically transforms the second transformed layout 18" a third time to create a third transformed layout 18''' to display the first image in any of the first set of plural cells 16 including a winning indicia 20 not selected by the player and to display the second image in any of the second set of plural cells including a non-winning indicia 22 not selected by the player with the received plural selection inputs.

In one embodiment different colors are used to distinguish winning indicia 20 (e.g., green, etc.) and non-winning indicia 22 (e.g., red, etc.).

In another embodiment, different colors are used to distinguish all winning and non-winning indicia 20, 22 for winning games 10 and/or for non-winning games 10. For example, all indicia 20, 22 may be displayed in a green color for a winning game 10 and in red for a non-winning game 10.

In one embodiment, the game application includes a graphical wager component 34, whereby an initial wager is required to initiate the game of chance 10, and whereby a prize is awarded for selecting and revealing the threshold number of winning indicia 20. A value of the prize varies depending upon the number of winning indicia 22 selected and revealed by the player and the initial wager. A value of the prize corresponding to the selection and revelation of a pre-determined number of winning indicia 22 being equivalent to the initial wager. The prize value corresponding to the selection and revelation of a pre-determined number of winning indicia 22 being equivalent to X-times the initial wager, where the value of X is a positive number.

However, the present invention is not limited to use of a graphical wager component 34, and the invention can be practiced without the graphical wager component 34.

The method and system described herein present game of chance having an outcome determined by the actions of a player. The game of chance comprising a layout defining plural cells. A first portion of the cells each have a winning indicia contained therein, and a remaining portion of the cells each have a non-winning indicia contained therein. The winning and non-winning indicia are initially concealed to a player and are selectively revealable by the player. The player may select a limited number of cells to reveal indicia contained therein. An object of the game is to maximize a number of winning indicia revealed by the player It should be understood that the architecture, programs, processes, methods and systems described herein are not related or limited to any particular type of computer or network system (hardware or software), unless indicated otherwise. Various types of general purpose or specialized computer systems may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

While various elements of the preferred embodiments have been described as being implemented in software, in other embodiments hardware or firmware implementations may alternatively be used, and vice-versa.

The claims should not be read as limited to the described order or elements unless stated to that effect. In addition, use of the term "means" in any claim is intended to invoke 35 U.S.C. § 112, paragraph 6, and any claim without the word "means" is not so intended.

Therefore, all embodiments that come within the scope and spirit of the following claims and equivalents thereto are claimed as the invention.

I claim:

1. A method for playing a game of chance comprising:

receiving a selection input on a game application on a cloud network device via a cloud communications network with one or more processors to initiate a new iteration of a game of chance on the cloud network device including a plurality of pooled cloud hardware resources providing: (1) unilateral provisioning of cloud computing capabilities and cloud computing hardware resources for on-demand game playing services, (2) broadband network access to game of chance network services on the cloud network device, (3) resource pooling with a plurality of different physical and virtual resources dynamically assigned and reassigned according to game of chance playing demand, (4) automatic provisioning and releasing of game of chance playing services, and (5) measured, metered controlling of game of chance playing services including monitoring and reporting game of chance playing usage;

receiving a second selection input on the game application on the cloud network device including a layout of the game of chance from a second cloud network device with one or more processors via a Near Field Communications (NFC) protocol, wherein the cloud network device and the second cloud network device are physically touching each other or the cloud network device and the second cloud network device are not physically touching but both physically located within a very small pre-determined physical distance required by the NFC protocol for communications to be established between network devices, the NFC protocol providing faster data communications and improved security for receiving the layout of the game of chance;

creating automatically from the game application an internal layout of a game of chance from the layout of the game of chance received in the second selection input including a plurality of individual cells in a pre-determined configuration in one or more data structures in a non-transitory computer readable medium on the cloud network device, the one or more data structures including a pre-determined data organization providing transformations of the created internal layout and display of the game of chance on a display component on the cloud network device when accessed in the non-transitory computer readable medium, the one or more data structures further including a dynamic binary tree dynamically adjusted based on selection inputs received on the game application as the player plays the game of chance on the cloud network device, the dynamic binary tree storing only winning indicia selected by the player of the game of chance;

adding automatically from the game application to the non-transitory computer readable medium a plurality of instructions for notifying a player of the game of chance that each iteration of the game of chance includes at least one possible winning outcome for all levels of offered prizes, and the player is able to select the at least one possible winning outcome for the all levels of offered prizes based exclusively on decisions and actions of the player, thereby assuring the player with a first assurance that each iteration of the game of chance includes at least one possible winning outcome;

adding automatically from the game application to the non-transitory computer readable medium a plurality of instructions and a button for verifying a final outcome of the game of chance by visually displaying on a display component on the cloud network device all locations of all winning indicia and non-winning indicia in the created internal layout for the played game of chance, and thereby providing a second assurance to the player that each iteration of the played game of chance is being played fairly based exclusively on decisions and actions of the player and is not subjected to manipulation or fraud by a provider of the game of chance;

designating automatically and randomly from the game application N-number of winning indicia into a first set of plurality of cells in the created internal layout, wherein the N-number of winning indicia is a pre-determined percentage of non-winning number of indicia and wherein the winning indicia included therein providing the at least one possible winning outcome selectable by the player for every iteration of the game of chance;

designating automatically from the game application M-number of non-winning indicia into a second set plurality of cells in the created internal layout not including winning indicia;

automatically including from the game application one or more instructions for generating a first desired image of a winning indicia in the first set of plurality of cells including a winning indicia;

automatically including from the game application one or more instructions for generating a second desired image of a non-winning indicia in the second set of plurality of cells including a non-winning indicia;

transforming automatically from the game application the created internal layout a first time to create a first transformed layout including one or more instructions for generating a third desired image in each of the plurality of cells in the created internal layout to conceal the first image of the winning indicia in the first set of plurality of cells and the second image of the non-winning indicia in the second set of plurality of cells;

displaying automatically from the game application on a display component on the cloud network device for a player the first transformed layout with the third desired image displayed in each of the plurality of cells, a verify game component and a notifications for the player of the game of chance that each iteration of the game of chance includes at least one possible winning outcome for all levels of offered prizes, and the player is able to select the at least one possible winning outcome for the all levels of offered prizes based exclusively on decisions and actions of the player;

receiving a plurality of selection inputs on the game application from the player selecting a plurality of individual cells within the first transformed game layout as the player plays the game of chance on the cloud network device;

transforming dynamically on the game application the one or more data structures including the dynamic binary tree into a different layout of the game of chance each time a selection input is received on the game application to improve a retrieval speed at which data is retrieved from the plurality of individual cells in the game of chance and a display speed at which the data displayed on the display component for the player of the game of chance, the dynamic binary tree transformed dynamically and dynamically adjusted each time the player selects an individual cell from the plurality of individual cells in the game of chance including a winning indicia, the dynamic binary tree storing only winning indicia that have been selected by the player of the game of chance, the dynamic binary tree improving a retrieval speed for retrieving winning indicia selected by the player of the game of chance and improving a display speed for displaying winning indicia displayed on the display component;

transforming automatically from the game application the first transformed layout a second time to create a second transformed layout to display the first image in any of the first set of plurality of cells including a winning indicia selected by the player and to display the second image in any of the second set of plurality cells including a non-winning indicia selected by the player with the received plurality of selection inputs;

determining from the game application whether the player has selected and revealed a threshold number of cells including winning indicia, and if so, declaring the player a winner of the played game of chance, and if not declaring the player a loser of the played game of chance;

receiving a final selection input from the button on the cloud network device on the game application to verify a final outcome of the game of chance; and transforming automatically from the game application the second transformed layout a third time to create a third transformed layout to display the first image in any of the first set of plurality of cells including a winning indicia not selected by the player and to display the second image in any of the second set of plurality cells including a non-winning indicia not selected by the player with the received plurality of selection inputs.

2. The method of claim 1, wherein the pre-determined configuration includes a two-dimensional matrix of X-rows and Y-columns, wherein the values of X and Y are positive integer numbers or a three-dimensional matrix of X-rows, Y-columns and Z-pages, wherein the values of X, Y and Z are positive integer numbers.

3. The method of claim 1 wherein the data structures include hash tables and graphs to improve the retrieval speed at which data is retrieved from the plurality of individual cells in the game of chance and the display speed at which the data is displayed on the display component.

4. The method of claim 1, further including a wager component, whereby an initial wager is required to initiate the game of chance, and whereby a prize is awarded for selecting and revealing the threshold number of winning indicia.

5. The Method of claim 4, wherein a value of the prize varies depending upon the number of winning indicia selected and revealed by the player and the initial wager.

6. The Method of claim 4, wherein the value of the prize corresponding to the selection and revelation of a pre-determined number of winning indicia being equivalent to the initial wager.

7. The method of claim 4, wherein the prize value corresponding to the selection and revelation of a pre-determined number of winning indicia being equivalent to X-times the initial wager, where the value of X is a positive number.

8. The method of claim 1, wherein the N-number of winning indicia comprise individual letters for a pre-determined word in a pre-determined language.

9. The method of claim 1, wherein the pre-determined word includes the word, BINGO, in the English language.

10. The method of claim 1, wherein the N-number of winning indicia comprise a sequence of numbers and individual letters in a pre-determined language.

11. The method of claim 1, wherein the N-number of winning indicia comprise a pre-determined sequence or pattern of numbers.

12. The method of claim 1, wherein the N-number of winning indicia comprise a pre-determined set of graphical symbols, graphical images, pre-determined set of digital images or a pre-determined set of video images.

13. The method of claim 1 wherein the second cloud network device includes a server network device with one or more processors.

14. The method of claim 1 wherein the communications interface includes a wired or wireless communications interface.

15. The method of claim 14 wherein the wireless communications interface includes a near field communications (NFC), machine-to-machine (M2M), 802.11a, 802.11ac, 802.11b, 802.11g, 802.11n, Wireless Fidelity (Wi-Fi), Wi-Fi Aware, Worldwide Interoperability for Microwave Access (WiMAX), ETSI High Performance Radio Metropolitan Area Network (HIPERMAN), RF Home, Bluetooth or Infrared wireless communications interface.

16. The method of claim 1 wherein the one or more data structures include cloud storage objects.

17. The method of claim 1 wherein the cloud network device includes wearable devices, mobile phones, non-mobile phones, smart phones, tablet computers, portable video gaming platforms, non-portable video gaming platforms, gambling machines, non-mobile computers, video gambling devices, kiosks, laptop computers, personal information devices, personal digital/data assistants (PDA), hand-held devices, televisions, network appliances, Internet appliances, cable television set-top boxes, Internet television set-top boxes or satellite television boxes.

18. The method of claim 1 wherein the step of receiving the selection the final selection input from the button on the cloud network device on the game application to verify the final outcome of the game of chance includes receiving the final selection input from a graphical button displayed on the display component of the network device or from a mechanical button on the network device.

19. A system for playing a game of chance comprising:

a cloud network device with one or more processors;

a cloud communications network;

a non-transitory computer readable medium on the cloud network device;

a game of chance stored in the non-transitory computer readable medium on the cloud network device;

a plurality of instructions for causing the one or more processors to be configured:

for receiving a selection input on a game application on a cloud network device via a cloud communications network with one or more processors to initiate a new iteration of a game of chance on the cloud network device including a plurality of pooled cloud hardware resources providing: (1) unilateral provisioning of cloud computing capabilities and cloud computing hardware resources for on-demand game playing services, (2) broadband network access to game of chance network services on the cloud network device, (3) resource pooling with a plurality of different physical and virtual resources dynamically assigned and reassigned according to game of chance playing demand, (4) automatic provisioning and releasing of game of chance playing services, and (5) measured, metered controlling of game of chance playing services including monitoring and reporting game of chance playing usage;

for receiving a second selection input on the game application on the cloud network device including a layout of the game of chance from a second cloud network device with one or more processors via a Near Field Communications (NFC) protocol, wherein the cloud network device and the second cloud network device are physically touching each other or the cloud network device and the second cloud network device are not physically touching but both physically located within a very small pre-determined physical distance required by the NFC protocol for communications to be established between network devices, the NFC protocol providing faster data communications and improved security for receiving the layout of the game of chance;

for creating automatically from the game application an internal layout of a game of chance from the layout of the game of chance received in the second selection input including a plurality of individual cells in a pre-determined configuration in one or more data structures in a non-transitory computer readable medium on the cloud network device, the one or more data structures including a pre-determined data organization providing transformations of the created internal layout and display of the game of chance on a display component on the cloud network device when accessed in the non-transitory computer readable medium, the one or more data structures further including a dynamic binary tree dynamically adjusted based on selection inputs received on the game application as the player plays the game of chance on the cloud network device, the dynamic binary tree storing only winning indicia selected by the player of the game of chance;

for adding automatically from the game application to the non-transitory computer readable medium a plurality of instructions for notifying a player of the game of chance that each iteration of the game of chance includes at least one possible winning outcome for all levels of offered prizes, and the player is able to select the at least one possible winning outcome for the all levels of offered prizes based exclusively on decisions and actions of the player, thereby assuring the player with a first assurance that each iteration of the game of chance includes at least one possible winning outcome;

for adding automatically from the game application to the non-transitory computer readable medium a plurality of instructions and a button for verifying a final outcome of the game of chance by visually displaying on a display component on the cloud network device all locations of all winning indicia and non-winning indicia in the created internal layout for the played game of chance, and thereby providing a second assurance to the player that each iteration of the played game of chance is being played fairly based exclusively on decisions and actions of the player and is not subjected to manipulation or fraud by a provider of the game of chance;

designating automatically and randomly from the game application N-number of winning indicia into a first set of plurality of cells in the created internal layout, wherein the N-number of winning indicia is a predetermined percentage of non-winning number of indicia and wherein the winning indicia included therein providing the at least one possible winning outcome selectable by the player for every iteration of the game of chance;

for designating automatically from the game application M-number of non-winning indicia into a second set plurality of cells in the created internal layout not including winning indicia;

for automatically including from the game application one or more instructions for generating a first desired image of a winning indicia in the first set of plurality of cells including a winning indicia;

for automatically including from the game application one or more instructions for generating a second desired image of a non-winning indicia in the second set of plurality of cells including a non-winning indicia;

for transforming automatically from the game application the created internal layout a first time to create a first transformed layout including one or more instructions for generating a third desired image in each of the plurality of cells in the created internal layout to conceal the first image of the winning indicia in the first set of plurality of cells and the second image of the non-winning indicia in the second set of plurality of cells;

for displaying automatically from the game application on a display component on the cloud network device for a player the first transformed layout with the third desired image displayed in each of the plurality of cells, a verify game component and a notifications for the player of the game of chance that each iteration of the game of chance includes at least one possible winning outcome for all levels of offered prizes, and the player is able to select the at least one possible winning outcome for the all levels of offered prizes based exclusively on decisions and actions of the player;

for receiving a plurality of selection inputs on the game application from the player selecting a plurality of individual cells within the first transformed game layout as the player plays the game of chance on the cloud network device;

transforming dynamically on the game application the one or more data structures including the dynamic binary tree into a different layout of the game of chance each time a selection input is received on the game application to improve a retrieval speed at which data is retrieved from the plurality of individual cells in the game of chance and a display speed at which the data displayed on the display component for the player of the game of chance, the dynamic binary tree transformed dynamically and dynamically adjusted each time the player selects an individual cell from the plurality of individual cells in the game of chance including a winning indicia, the dynamic binary tree storing only winning indicia that have been selected by the player of the game of chance, the dynamic binary tree improving a retrieval speed for retrieving winning indicia selected by the player of the game of chance and improving a display speed for displaying winning indicia displayed on the display component;

for transforming automatically from the game application the first transformed layout a second time to create a second transformed layout to display the first image in any of the first set of plurality of cells including a winning indicia selected by the player and to display the second image in any of the second set of plurality cells including a non-winning indicia selected by the player with the received plurality of selection inputs;

for determining from the game application whether the player has selected and revealed a threshold number of cells including winning indicia, and if so, declaring the player a winner of the played game of chance, and if not declaring the player a loser of the played game of chance;

for receiving a final selection input from the button on the cloud network device on the game application to verify a final outcome of the game of chance; and for transforming automatically from the game application the second transformed layout a third time to create a third transformed layout to display the first image in any of the first set of plurality of cells including a winning indicia not selected by the player and to display the second image in any of the second set of plurality cells including a non-winning indicia not selected by the player with the received plurality of selection inputs.

* * * * *